US007901034B2

(12) United States Patent
Yoshida

(10) Patent No.: US 7,901,034 B2
(45) Date of Patent: Mar. 8, 2011

(54) IMAGE FORMING DEVICE FOR PERFORMING IDLE DISCHARGE

(75) Inventor: Takahiro Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 126 days.

(21) Appl. No.: 12/159,658

(22) PCT Filed: Nov. 14, 2007

(86) PCT No.: PCT/JP2007/072493

§ 371 (c)(1),
(2), (4) Date: Jun. 30, 2008

(87) PCT Pub. No.: WO2008/062809

PCT Pub. Date: May 29, 2008

(65) Prior Publication Data

US 2009/0289975 A1 Nov. 26, 2009

(30) Foreign Application Priority Data

Nov. 23, 2006 (JP) ..... 2006-316381
Aug. 22, 2007 (JP) ..... 2007-216336

(51) Int. Cl.
*B41J 2/165* (2006.01)
*B41J 29/38* (2006.01)

(52) U.S. Cl. ..... 347/35; 347/11

(58) Field of Classification Search ..... 347/35
See application file for complete search history.

(56) References Cited

U.S. PATENT DOCUMENTS 5,659,342 A * 8/1997 Lund et al. ..... 347/35
5,903,288 A * 5/1999 Yamaguchi ..... 347/35
7,264,338 B2 9/2007 Ogata et al.
2005/0219323 A1 10/2005 Kusakari
2006/0055715 A1* 3/2006 Nakahara et al. ..... 347/5
2006/0176329 A1* 8/2006 Usui ..... 347/11
2006/0209119 A1 9/2006 Yonekubo et al.

(Continued)

FOREIGN PATENT DOCUMENTS

EP 0790128 A2 8/1997

(Continued)

OTHER PUBLICATIONS

Nov. 18, 2010 European search report in connection with counterpart European patent appilication No. 07832223.

*Primary Examiner* — Matthew Luu
*Assistant Examiner* — Shelby Fidler
(74) *Attorney, Agent, or Firm* — Cooper & Dunham LLP

(57) ABSTRACT

In an image forming device including a liquid discharge head in which nozzles for discharging liquid drops are arranged side by side, a drive waveform generating unit generates, within a single drive cycle, a first drive waveform containing a drive signal to discharge an amount of liquid drop used for image formation, and a second drive waveform containing a drive signal to discharge an amount of liquid drop smaller than a minimum discharge drop amount used for image formation. A head control unit causes the liquid discharge head to discharge the amount of liquid drop used for image formation in accordance with the first drive waveform for a region where an image is formed, and to discharge the amount of liquid drop smaller than the minimum discharge drop amount in accordance with the second drive waveform for a region where any image is not formed.

11 Claims, 20 Drawing Sheets

U.S. PATENT DOCUMENTS

| | | | | |
|---|---|---|---|---|
| 2007/0097163 | A1 | 5/2007 | Shingyohuchi et al. | |
| 2007/0165064 | A1* | 7/2007 | Misumi et al. | 347/35 |
| 2009/0147034 | A1* | 6/2009 | Yoshida | 347/10 |

FOREIGN PATENT DOCUMENTS

| | | | |
|---|---|---|---|
| JP | 11-105304 | | 4/1999 |
| JP | 2001-26123 | | 1/2001 |
| JP | 2001-105589 | | 4/2001 |
| JP | 2002-248766 | | 9/2002 |
| JP | 2003-191496 | | 7/2003 |
| JP | 2005-7899 | | 1/2005 |
| JP | 2005-313624 | | 11/2005 |
| WO | WO2005/000589 | A1 | 1/2005 |

* cited by examiner

FIG.16

| DROP CONTROL SIGNAL | DISCHARGE DRIVE SIGNAL | DISCHARGE DROP AMOUNT |
|---|---|---|
| MN0 | P13 | 0 pl (FINE DRIVE) |
| MN1 | P11 | 3 pl (SMALL DROP) |
| MN2 | P11,P13,P14 | 11 pl (LARGE DROP) |
| MN3 | P12 | below 2 pl (VERY SMALL DROP) |

FIG.18

| DROP CONTROL SIGNAL | DISCHARGE DRIVE SIGNAL | DISCHARGE DROP AMOUNT |
|---|---|---|
| MN0 | P13 | 0 pl (FINE DRIVE) |
| MN1 | P11 | 3 pl (SMALL DROP) |
| MN2 | P11,P12,P13,P14 | 15 pl (LARGE DROP) |
| MN3 | P12 | below 2 pl (VERY SMALL DROP) |

IMAGE FORMING DEVICE FOR PERFORMING IDLE DISCHARGE

TECHNICAL FIELD

This disclosure relates to an image forming device and a printed matter. More particularly, this disclosure relates to an image forming device including a liquid discharge head, and a printed matter on which an image is formed by the image forming device.

BACKGROUND ART

There is known an image forming device, such as a printer, a fax, a copier, a plotter or a multi-function peripheral having multiple image forming functions (including print, fax, copy, and the like functions), which uses a liquid discharge mechanism. The liquid discharge mechanism includes a recording head in which liquid discharge heads for discharging drops of recording liquid are arranged. With this recording head, image formation (which is inclusive of image recording and printing) is carried out by discharging drops of the recording fluid (ink) to a medium (recording sheet) while the medium (recording sheet) is transported.

An image forming device hereinafter refers to a device which performs image formation by discharging liquid drops to a medium (which is inclusive of paper, yarns, fibers, textile, leather, metal, plastics, glass, wood, ceramics, etc.). Image formation hereinafter refers to not only formation of images with meaningful characters, figures, etc. but also formation of images with meaningless patterns, etc. Liquid hereinafter is not restricted to a recording fluid or ink, but refers to any fluid which is a liquid state when it is discharged. A liquid discharge device hereinafter refers to a device in which a liquid discharge head discharges liquid drops, and it is not limited to a device which performs image formation.

The image forming devices provided with liquid discharge heads are classified into two types: a serial type image forming device in which a recording head provided on a carriage is moved in a main scanning direction perpendicular to a sheet transport direction to perform recording or printing; and a full-line type image forming device which uses a full-line type recording head in which a plurality of ejection holes (nozzles) for discharging liquid drops are arranged to cover the overall recording region.

A liquid discharge head for use in an image forming device is arranged to discharge liquid drops from ejection holes in order to perform recording or printing. If a non-discharge state of the liquid discharge head keeps on for a certain period, the viscosity of the liquid in the ejection holes is increased by evaporation of the solvent, etc. If the discharge operation is started from the non-discharge state, the discharging state of the head is disturbed with the increased viscosity and the liquid discharge head will be inoperable and the printing quality will deteriorate. To avoid this, idle discharge operation in which liquid drops (waste fluid) that are not used for image formation are discharged from the nozzles is performed and the recording fluid remaining in the nozzles with the viscosity increased is eliminated.

Regarding idle discharge operation, Japanese Laid-Open Patent Application No. 11-105304 discloses an ink jet printer in which an ink jet head is provided with a preliminary discharge unit which performs preliminary discharging of ink for preventing clogging of the nozzles in the ink jet head, in a position separated from a recording medium during the scanning of the ink jet head on the recording medium.

Japanese Laid-Open Patent Application No. 2001-026123 discloses an ink jet recorder in which data for ejecting flushing dots from a nozzle for ejecting a small amount of ink is generated based on print data for one path. A head driving unit performs a printing operation in accordance with the data wherein printing dots as well as flushing dots smaller than the printing dots are ejected to a recording medium during the scanning of a carriage. As a result, the flushing dots are suitably ejected from the small-amount ejecting nozzle during the period of one path as needed, and it is possible to assure that the normal printing operation is performed even by a recorder using a comparatively large sized recording medium. Moreover, Japanese Laid-Open Patent Application No. 2005-313624 discloses a liquid discharge head which performs a preliminary discharge operation during a normal printing operation.

Japanese Laid-Open Patent Application No. 2005-007899 discloses a full-line ink-jet recording device in which an idle discharge region for performing idle discharge of liquid drop is set up in a position separated from a recording region. An idle discharge recording liquid portion for receiving the liquid drops when idle discharge is performed is arranged in the idle discharge region. A recording head unit including a full-line ink jet head is moved or rotated to the idle discharge region, and it is caused to perform idle discharge operation. Thereafter, the recording head unit is returned to the recording region by performing a head returning operation.

Moreover, Japanese Laid-Open Patent Application No. 2001-105589 discloses a method of driving a liquid discharge head. Japanese Laid-Open Patent Application No. 2002-248766 discloses an image forming device which uses an ink in which charged particles are distributed in a solvent.

However, it is difficult to apply the idle discharge method which performs idle discharge (preliminary discharge) operation in a position separated from the recording medium during the print scanning, according to Japanese Laid-Open Patent Application No. 11-105304, to the full-line type image forming device in which the recording head is moved. Even if the application of the idle discharge method mentioned above is possible, the problem that the printing speed in such a case extremely falls remains unresolved.

The idle discharge method which generates the data for idle discharge (flushing) based on the print data for one path and performs idle discharge within one print path, according to Japanese Laid-Open Patent Application No. 2001-026123 and others, would require the analysis of data with little ink discharge, the generation of the data for idle discharge according to image data, and the switching of the drive circuits which generate a drive waveform for normal printing and a drive waveform for idle discharge. Therefore, the problem that the processing is complicated and the cost is increased remains unresolved.

DISCLOSURE OF THE INVENTION

According to an aspect of this disclosure, there is provided an image forming device which carries out idle discharge operation of a liquid discharge head using a simple, inexpensive mechanism.

According to another aspect of this disclosure there is provided a printed matter on which an image is formed by the above-mentioned image forming device.

In an exemplary embodiment an image forming device which forms an image on a medium includes a liquid discharge head in which a plurality of nozzles for discharging liquid drops are arranged side by side, the image forming device comprising: a drive waveform generating unit generating, within a single drive cycle, a first drive waveform containing a drive signal to discharge an amount of liquid drop used for image formation, and a second drive waveform containing a drive signal to discharge an amount of liquid drop smaller than a minimum discharge drop amount used for image formation; and a head control unit causing the liquid discharge head to discharge the amount of liquid drop used for image formation in accordance with the first drive waveform for a region where an image is formed, and causing the liquid discharge head to discharge the amount of liquid drop smaller than the minimum discharge drop amount in accordance with the second drive waveform for a region where any image is not formed.

The above-mentioned image forming device may be configured so that the region where any image is not formed corresponds to a region of the medium in which the medium is transported in a transport direction.

The above-mentioned image forming device may be configured so that the region where any image is not formed corresponds to an end portion of the image-formation region of the medium in a direction perpendicular to a transporting direction in which the medium is transported.

The above-mentioned image forming device may be configured so that each of the drive signal in the first drive waveform and the drive signal in the second drive waveform contains a pressing waveform element which makes a liquid drop discharge by shrinking a liquid chamber communicating with one of the plurality of nozzles of the liquid discharge head, and a voltage change of the pressing waveform element of the drive signal in the second drive waveform is smaller than a voltage change of the pressing waveform element of the drive signal in the first drive waveform.

The above-mentioned image forming device may be configured so that each of the drive signal in the first drive waveform and the drive signal in the second drive waveform contains a pressing waveform element which makes a liquid drop discharge by shrinking a liquid chamber communicating with one of the plurality of nozzles of the liquid discharge head, and a change time of the pressing waveform element of the drive signal in the second drive waveform is longer than a change time of the pressing waveform element of the drive signal in the first drive waveform.

The above-mentioned image forming device may be configured so that each of the drive signal in the first drive waveform and the drive signal in the second drive waveform contains a drawing waveform element which causes a liquid chamber communicating with one of the plurality of nozzles of the liquid discharge head to expand, and a voltage change of the drawing waveform element of the drive signal in the second drive waveform is larger than a voltage change of the drawing waveform element of the drive signal in the first drive waveform.

The above-mentioned image forming device may be configured so that each of the drive signal in the first drive waveform and the drive signal in the second drive waveform contains a drawing waveform element which causes a liquid chamber communicating with one of the plurality of nozzles of the liquid discharge head to expand, and a change time of the drawing waveform element of the drive signal in the second drive waveform is shorter than a change time of the drawing waveform element of the drive signal in the first drive waveform.

The above-mentioned image forming device may be configured so that the liquid discharge head is a full-line type recording head.

The above-mentioned image forming device may be configured so that the medium is a rolled-form medium.

The above-mentioned image forming device may be configured so that, when an idle discharge operation is performed to discharge liquid drops which do not contribute to image formation, the liquid discharge head discharges, over an entire image formable region of the medium in a width direction of the medium, the amount of liquid drop smaller than the minimum discharge drop amount.

In another embodiment, there is provided a printed matter on which an image is formed by the above-mentioned image forming device through discharging of liquid drops to the medium.

In another embodiment, there is provided an image forming device which forms an image on a medium and includes a liquid discharge head in which a plurality of nozzles for discharging liquid drop are arranged side by side, the image forming device comprising: a drive waveform generating unit generating, within a single drive cycle, a first drive waveform containing a first drive signal to discharge an amount of liquid drop used for image formation, and a second drive waveform containing a second drive signal to discharge an amount of liquid drop smaller than a minimum discharge drop amount used for image formation; and a selecting unit selecting at least one of the first drive signal in the first drive waveform and the second drive signal in the second drive waveform in response to a control signal, to output the selected drive signal to the liquid discharge head.

The above-mentioned image forming device may be configured so that the drive waveform generating unit is arranged to generate a plurality of the first drive signals in time series, and the second drive signal being interposed between two of the plurality of the first drive signals.

The above-mentioned image forming device may be configured so that the selecting unit is arranged to select the second drive signal concurrently with the first drive signal when forming an image.

The above-mentioned image forming device may be configured so that the drive waveform generating unit is arranged to generate the second drive waveform having a waveform element adapted to tear off a part of a liquid drop discharged from the liquid discharge head.

The above-mentioned image forming device may be configured so that the drive waveform generating unit is arranged so that a discharge drop speed of the amount of liquid drop smaller than the minimum discharge drop amount used for image formation is slower than a discharge drop speed of the minimum discharge drop amount used for image formation.

According to the embodiments of the image forming device of the invention, it is possible to perform idle discharge operation using a simple, inexpensive mechanism.

BRIEF DESCRIPTION OF THE DRAWINGS

Other aspects, features and advantages will be apparent from the following detailed description when reading in conjunction with the accompanying drawings.

FIG. 16 is a diagram showing the relationship between a drop control signal and a discharge drop amount in the embodiment of FIG. 15.

FIG. 18 is a diagram showing the relationship between a drop control signal and a discharge drop amount in the embodiment of FIG. 17.

BEST MODE FOR CARRYING OUT THE INVENTION

A description will be given of embodiments of the invention with reference to the accompanying drawings.

Figure 1:
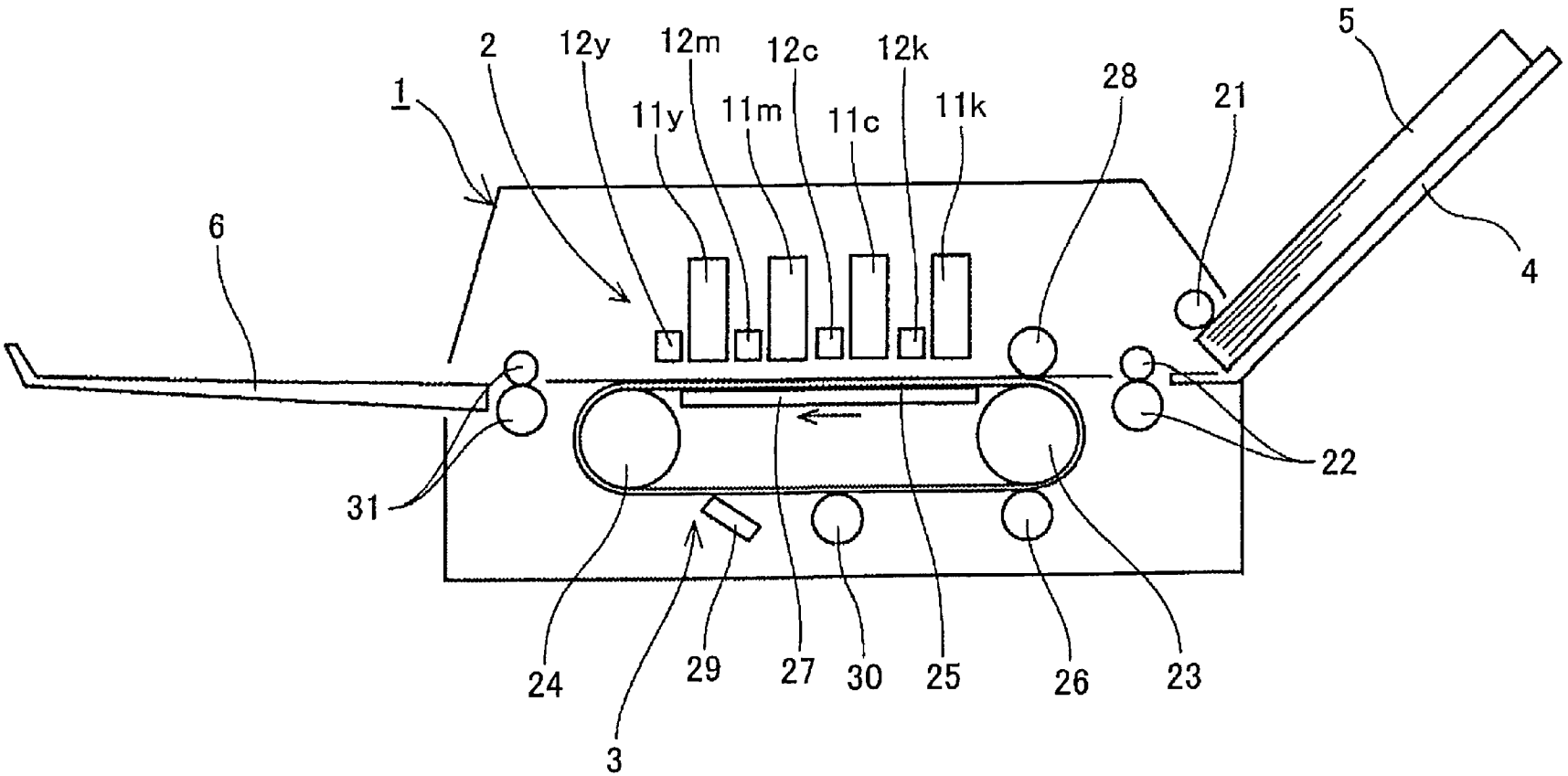
FIG. 1 is a diagram showing the composition of an image forming device in an embodiment of the invention.

FIG. 1 is a diagram showing the composition of the mechanical part of an image forming device in an embodiment of the invention.

The image forming device 1 of this embodiment is a full-line type image forming device wherein a recording head is constituted by a full-line type liquid discharge head having rows of nozzles (in which plural nozzles are arrayed in each row) and having a longitudinal length, larger than the width of a recording region of a recording sheet (medium).

The image forming device 1 includes an image formation part 2 inside the image forming device 1 and a transport mechanism 3 which transports a recording sheet. A medium tray 4 which accommodates several recording sheets 5 is attached to one side of the image forming device 1. Alternatively, a roll-sheet supply mechanism (which is not illustrated) which supplies a roll sheet (rolled-form medium) to the image formation part 2 may be attached to one side of the image forming device 1.

In the image forming device 1, a recording sheet 5 (or roll sheet) from the medium tray 4 is supplied to the transport mechanism 3, and an image is formed on the recording sheet 5 by the image formation part 2 while the recording sheet 5 (or roll sheet) is transported. The recording sheet 5 after the image formation is completed is delivered to a sheet output tray 6 which is attached to the other side of the image forming device 1.

Figure 2:
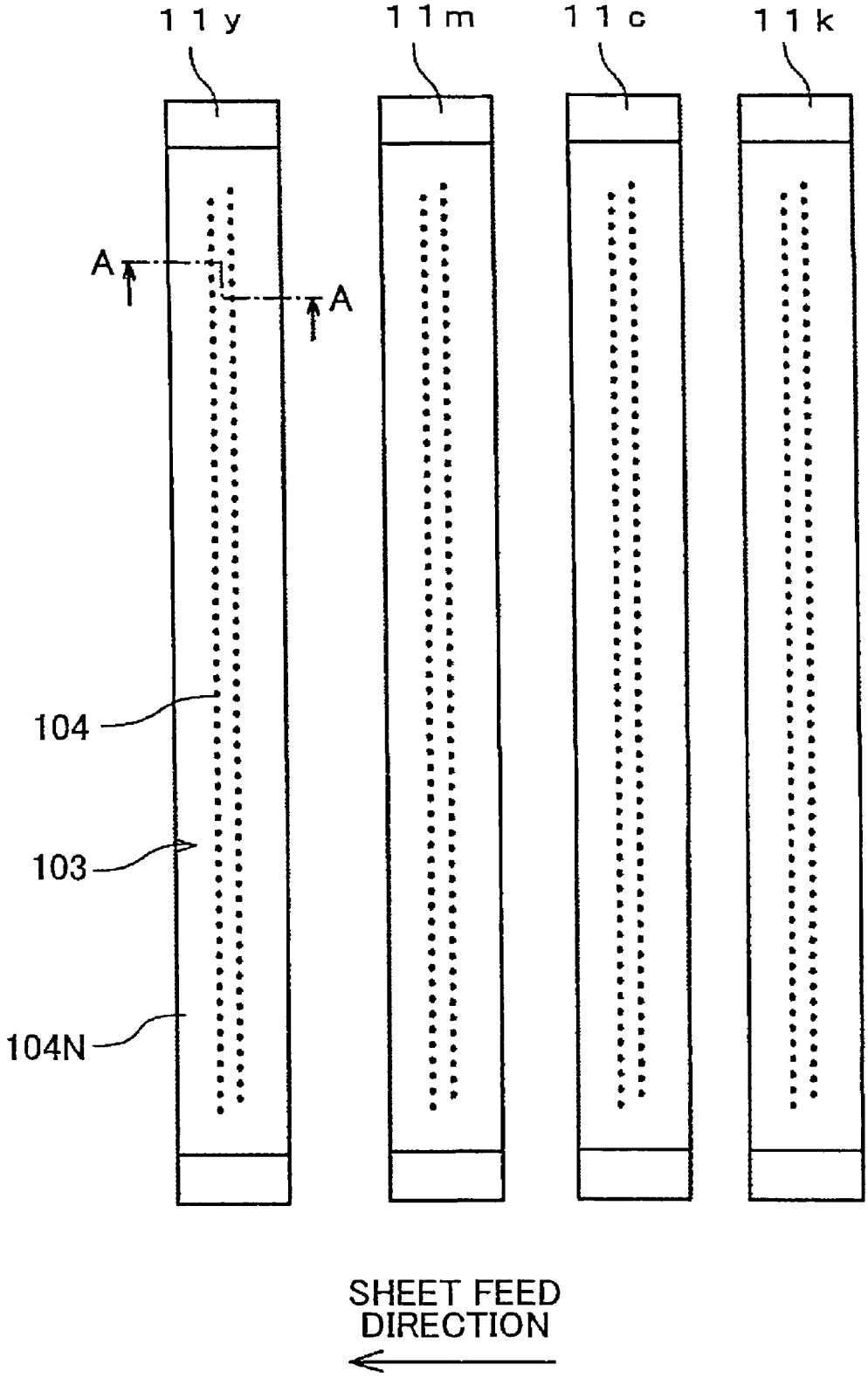
FIG. 2 is a diagram showing the composition of a recording head in the image forming device of FIG. 1.

As shown in FIG. 2, the image forming device 1 includes the recording heads 11*k*, 11*c*, 11*m* and 11*y* (which may be called collectively recording head 11) which discharge liquid drops of the color of black (K), cyan (C), magenta (M) and yellow (Y), respectively. The recording heads 11*k*, 11*c*, 11*m* and 11*y* are constituted by four full-line type liquid discharge heads, and the respective recording heads 11 are attached to a head holder (which is not illustrated) with the nozzle surface 104N (nozzles 104 are formed therein) faced down.

The image forming device 1 as shown in FIG. 1 includes maintenance/recovery devices 12*k*, 12*c*, 12*m* and 12*y* (which may be called collectively maintenance/recovery device 12) which perform maintenance and recovery of the performance of the respective recording heads 11. At the time of performance maintenance operation of the respective recording heads, such as a purging process and a wiping process, the recording head 11 and the maintenance/recovery device 12 are moved relative to each other, and the capping member which constitutes a part of the maintenance/recovery device 12 is made to face the nozzle surface 104N of the recording head 11.

In this embodiment, the black, cyan, magenta and yellow recording heads 11 are arranged in this order in a sequence from the upstream side of the recording sheet transporting direction to discharge the liquid drops of each color to the recording sheet. However, the arrangement and the number of colors of the recording heads according to the invention are not limited to this embodiment.

One or a plurality of full-line type recording heads in which a plurality of nozzle rows are arranged at given intervals may also be used instead. The recording head and the recording fluid cartridge which supplies the recording fluid to the recording head may be formed into an integral component or they are formed as separate components.

The image forming device 1 includes a sheet supply roller 21 which separates one sheet from the recording sheets 5 of the medium tray 4 and supplies the sheet to the image forming device 1 at a time, and sheet supply rollers 22 which deliver the sheet to the transport mechanism 3. When the image forming device 1 is provided with the roll-sheet supply mechanism, a roll sheet is continuously delivered to the transport mechanism 3 by means of the sheet supply rollers 22.

The transport mechanism 3 includes the following elements. A transporting belt 25 of endless type is wound between a drive roller (transport roller) 23 which is rotated by the drive motor (not illustrated) and a driven roller 24. A charging roller 26 is provided to charge the transporting belt 25 electrically. A guide member (platen plate) 27 is provided to guide the transporting belt 25 in the portion which faces the image formation part 2. A retaining roller 28 is arranged opposite to the driving roller 23 to retain the recording sheet 5 (or roll sheet), sent from the sheet supply part, against the drive roller 23. A recording fluid wiping member (or cleaning blade) 29 which is made of a porous material is a cleaning unit provided to remove the recording fluid (ink) adhering to the transporting belt 25. And an electric discharge roller 30 is provided to electrically discharge the transporting belt 25.

In addition, delivery rollers 31 are provided at the downstream portion of the transport mechanism 3 to deliver the recording sheet 5 (or roll sheet) on which the image is formed, to the sheet output tray 6.

In the full-line type image forming device described above, the transporting belt 25 is electrically charged and the recording sheet 5 (or roll sheet) is delivered to the transporting belt 25, so that the recording sheet 5 (or roll sheet) is attracted by the electrostatic force of the transporting belt 25 and it is transported by the rotating movement of the transporting belt 25. An image is formed on the recording sheet by the liquid drops of the respective colors discharged from the recording heads 11*k*, 11*c*, 11*m* and 11*y* of the image formation part 2. The recording sheet on which the image is formed is delivered to the sheet output tray 6.

A description will be given of an example of a liquid discharge head which constitutes a part of the recording head 11 with reference to FIG. 3 and FIG. 4.

Figure 3:
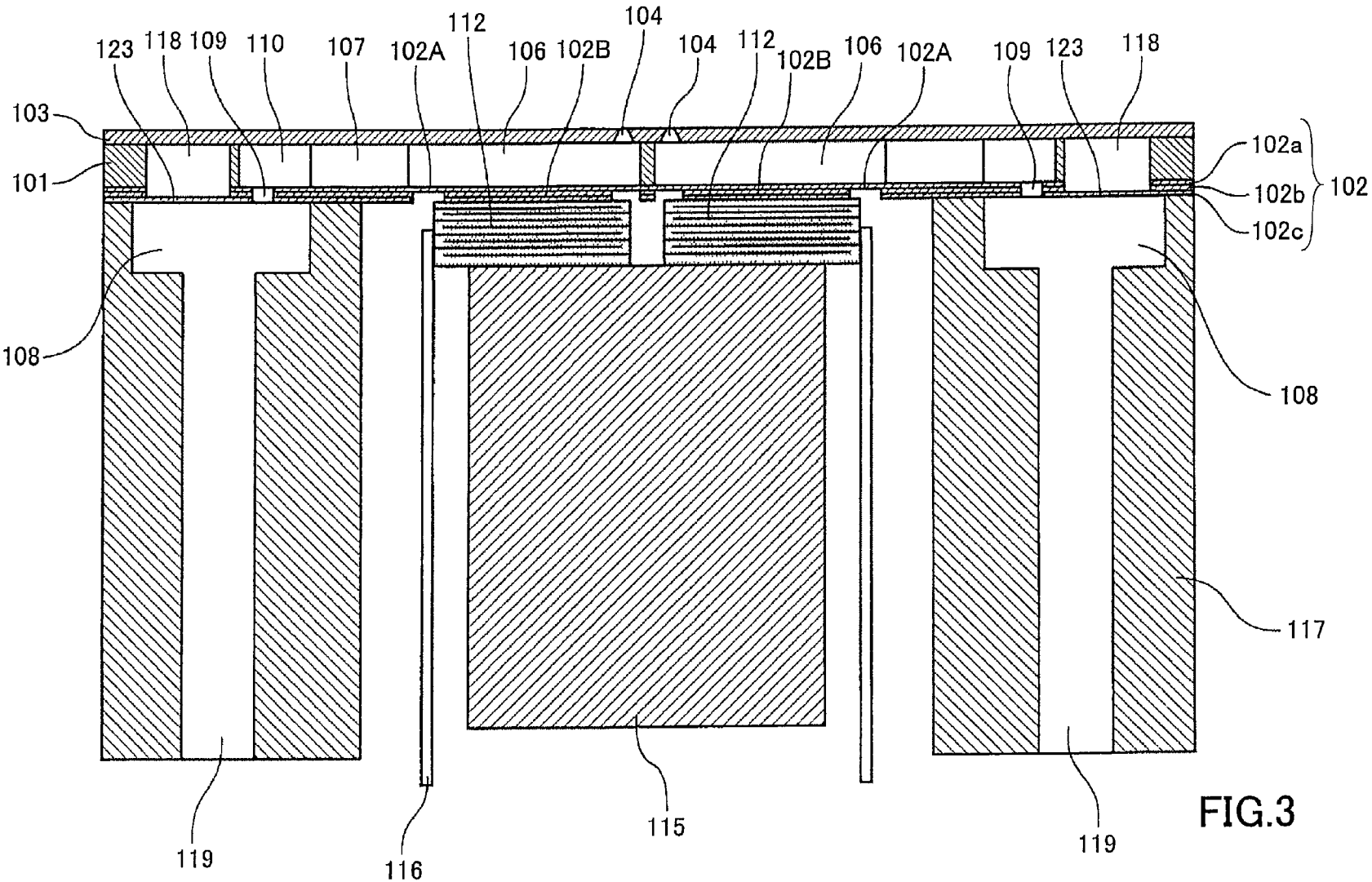
FIG. 3 is a cross-sectional view of a liquid discharge head, which constitutes a part of the recording head of FIG. 2, taken along a longitudinal direction of a liquid chamber of the liquid discharge head.
Figure 4:
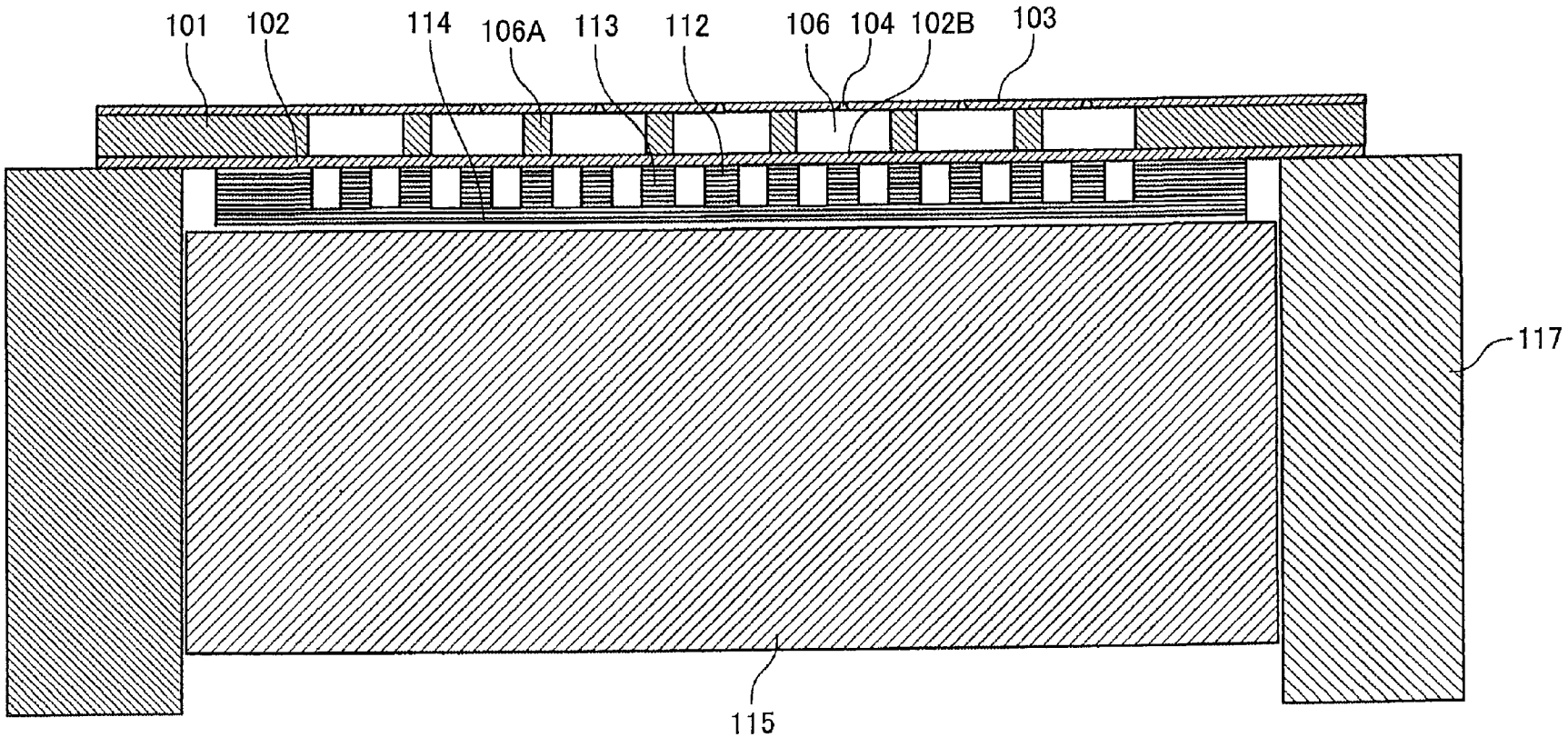
FIG. 4 is a cross-sectional view of the liquid discharge head, which constitutes a part of the recording head of FIG. 2, taken along a lateral direction of the liquid chamber.

FIG. 3 is a cross-sectional view of the liquid discharge head taken along the line A-A indicated in FIG. 2 in a longitudinal direction of a liquid chamber of the liquid discharge head (which direction is perpendicular to the direction of the nozzle row). FIG. 4 is a cross-sectional view of the liquid discharge head taken along a lateral direction of the liquid chamber (which direction is parallel to the direction of the nozzle row).

The liquid discharge head includes the following elements: a channel plate (liquid chamber substrate) 101; a diaphragm plate 102 which is bonded to the undersurface of the channel plate (liquid chamber substrate) 101 and this channel plate 101; and a nozzle plate 103 which is bonded to the upper surface of the channel plate 101 (or formed integrally with the channel plate 101).

Moreover, the channel plate 101, the diaphragm plate 102 and the nozzle plate 103 constitute the following elements: a pressurized liquid chamber which is provided as an individual passage to communicate with nozzles 104 for discharging liquid drops; a fluid resistance part 107 which is provided as a liquid supply passage which supplies the ink (recording fluid) to the pressurized liquid chamber 106; and a damper chamber 118 which is provided adjacent to a common liquid chamber 108.

In this embodiment, the channel plate 101 is produced from an SUS substrate through machining, punching or etching using an acid etching solution, and the channel plate 101 forms various openings of the pressurized liquid chamber 106, the fluid resistance part 107 and the damper chamber 118, respectively.

As mentioned above, the channel plate 101 and the nozzle plate 103 or the diaphragm plate 102 may be formed together through electrocasting. The channel plate 101 may be formed by performing anisotropic etching of a single crystal silicon substrate of crystal face orientation (110) using alkaline etching solution, such as a potassium hydroxide solution (KOH). Alternatively, the channel plate 101 may be formed using a photosensitive resin.

As shown in FIG. 3, the diaphragm plate 102 is formed from a three-layered nickel plate including a first layer 102*a*, a second layer 102*b* and a third layer 102*c* which are laminated from the liquid chamber 106 side, and the diaphragm plate 102 is produced through electrocasting, for example. Alternatively, the diaphragm plate 102 may be formed from a laminated member made of a resin, such as polyimide, and a metal plate, such as an SUS substrate, or formed from a resin member, for example.

The nozzle plate 103 forms various nozzles 104 corresponding to the respective pressurized liquid chambers 106, and this nozzle plate 103 is bonded to the channel plate 101 by an adhesive agent.

The source materials suitable for forming the nozzle plate 103 may include a metal material, such as stainless steel and nickel, a resin material, such as a polyimide resin, silicon, and their combination.

The internal shape of the nozzle 104 is a horn-like shape (or a generally cylindrical shape or truncated cone shape may be used), and the inside diameter of the nozzle 104 is in a range of 20-35 micrometers as the diameter on the side of an ink drop outlet. The pitch of nozzles of each row is set to 150 dpi.

A water-repellent-finish layer (not illustrated) which is subjected a water-repellent surface treatment is provided on the nozzle surface 104N (the surface in the discharge direction) of the nozzle plate 103. The water-repellent-finish layer may be formed through PTFE-Ni eutectic plating or electrodeposition of fluororesin, vapor deposition of fluororesin with evaporativity, or baking after solvent spreading of silicon-based resin or fluorine-based resin etc.

In the diaphragm plate 102, as shown in FIG. 3, a diaphragm part 102A corresponding to each pressurized liquid chamber 106 is formed by the first layer 102*a*, and a projection part 102B of two-layer structure is formed in the middle of the diaphragm part 102A by the second layer 102*b* and the third layer 102*c*. Each of the piezoelectric elements 112 which constitute the energy generating unit (actuator unit) is bonded to the projection part 102B, respectively.

Corresponding to a partition 106A of each pressurized liquid chamber 106, the support part 113 is bonded to the three-layer structured portion (thick portion 102B).

The piezoelectric elements 112 and the support parts 113 are formed through slit processing by half-cut dicing of a laminated piezoelectric element member 114. The support parts 113 are also piezoelectric elements, but no drive voltage is applied to the support parts 13 and they serve as a support for the diaphragm plate 102. The laminated piezoelectric element member 114 is bonded to the base member 115.

For example, the piezoelectric elements 112 (piezoelectric element member 114) are made by laminating alternately a piezoelectric layer of lead titanate zirconate (PZT) whose thickness per layer is in a range of 10-50 micrometers, and an internal electrode layer of silver/palladium (AgPd) whose thickness per layer is several micrometers. The internal electrodes are electrically connected to the individual electrode and the common electrode, and a drive signal is supplied to these electrodes via an FPC cable 116.

The recording head may configured so that the recording fluid in the liquid chamber 106 is pressurized using a piezoelectric displacement of the piezoelectric element 112 in d33 direction. Alternatively, the recording head may configured so that the recording fluid in the liquid chamber 106 is pressurized using a piezoelectric displacement of the piezoelectric element 112 in d31 direction.

The recording head in this embodiment employs the configuration which utilizes the displacement of the piezoelectric element 112 in d33 direction.

It is preferred that the base member 115 is formed using a metallic material. When the material of the base member 115 is metal, it is possible to prevent the heat accumulation of the piezoelectric element 112 by the self-heating thereof. Bonding of the piezoelectric element 112 and the base member 115 may be performed using an adhesive agent. However, when the number of channels increases as in the full-line type recording head, the temperature rises to about 100 degrees C. by the self-heating of the piezoelectric element 112 and the bonding strength falls remarkably.

The temperature rise inside the recording head occurs by the self-heating and the ink temperature rises, and if the temperature of ink rises, ink viscosity will fall and it will have significant influences on discharging properties.

Therefore, the base member 115 is formed using a metallic material, to prevent the heat accumulation by the self-heating of the piezoelectric element 112. Furthermore, this allows the degradation of the jetting properties due to the fall of such bonding strength and the fall of recording fluid viscosity to be prevented.

Moreover, a frame member 117 which is formed through injection molding of an epoxy-based resin or polyphenylene sulfite is bonded to the circumference of the diaphragm plate 102 by an adhesive agent.

A common liquid chamber 108 which supplies the recording fluid to each pressurized liquid chamber 106 is formed in the frame member 117. The recording fluid from the common liquid chamber 108 is supplied to the pressurized liquid chamber 106 via the feed hole 109 formed in the diaphragm plate 102, the passage 110 formed in the upstream of the fluid resistance part 107, and the fluid resistance part 107. A recording fluid feed hole 119 for supplying the recording fluid to the common liquid chamber 108 externally is also formed in the frame member 17.

A portion of the wall surface of the common liquid chamber 108 is formed by the diaphragm plate 102 which forms the wall surface of the liquid chamber 106. The portion which forms the wall surface of the common liquid chamber 108 is formed into a damper part 124. The damper part 124 forms the wall part of the adjoining damper chamber 118 to absorb the pressure fluctuation arising in the common liquid chamber 108. The damper chamber 118 is open to the atmosphere through the air opening which is not illustrated.

In the liquid discharge head mentioned above, when the voltage applied to the piezoelectric element 112 falls from the reference voltage Ve, the piezoelectric element 112 is caused to contract, the diaphragm 2 is caused to descend, so that the capacity of pressurized liquid chamber 106 is expanded and the ink flows into the liquid chamber 106. After that, when the voltage applied to the piezoelectric element 112 rises, the piezoelectric element 112 is caused to expand in the lamination direction. The diaphragm plate 102 is deformed in the nozzle 104 direction, and the capacity/volume of the liquid chamber 106 is decreased, so that the recording fluid in the liquid chamber 106 is pressurized, and a drop of the recording fluid is discharged (ejected) from the nozzle 104.

Subsequently, when the voltage applied to the piezoelectric element 112 is returned to the reference voltage, the diaphragm plate 102 is returned to the initial position, and the liquid chamber 106 is caused to expand. At this time, negative pressure arises in the liquid chamber 106, and the liquid chamber 106 is refilled with recording fluid from the common liquid chamber 108.

After oscillation of the meniscus of the nozzle 104 is declined and the nozzle meniscus is stabilized, the liquid discharge head is shifted to subsequent operation for discharging a liquid drop from the nozzle 104.

In this embodiment, the piezoelectric type liquid discharge head which uses piezoelectric elements as the energy generating unit (actuator unit) will be described. Alternatively, a liquid discharge head using another actuator unit, such as a thermal head which uses an exothermic resistor for an actuator unit, and an electrostatic head which uses as the actuator unit a diaphragm and an electrode which generate electrostatic force, may also be used as the recording head 11.

Next, a control system of the image forming device of this embodiment will be described with reference to FIG. 5.

Figure 5:
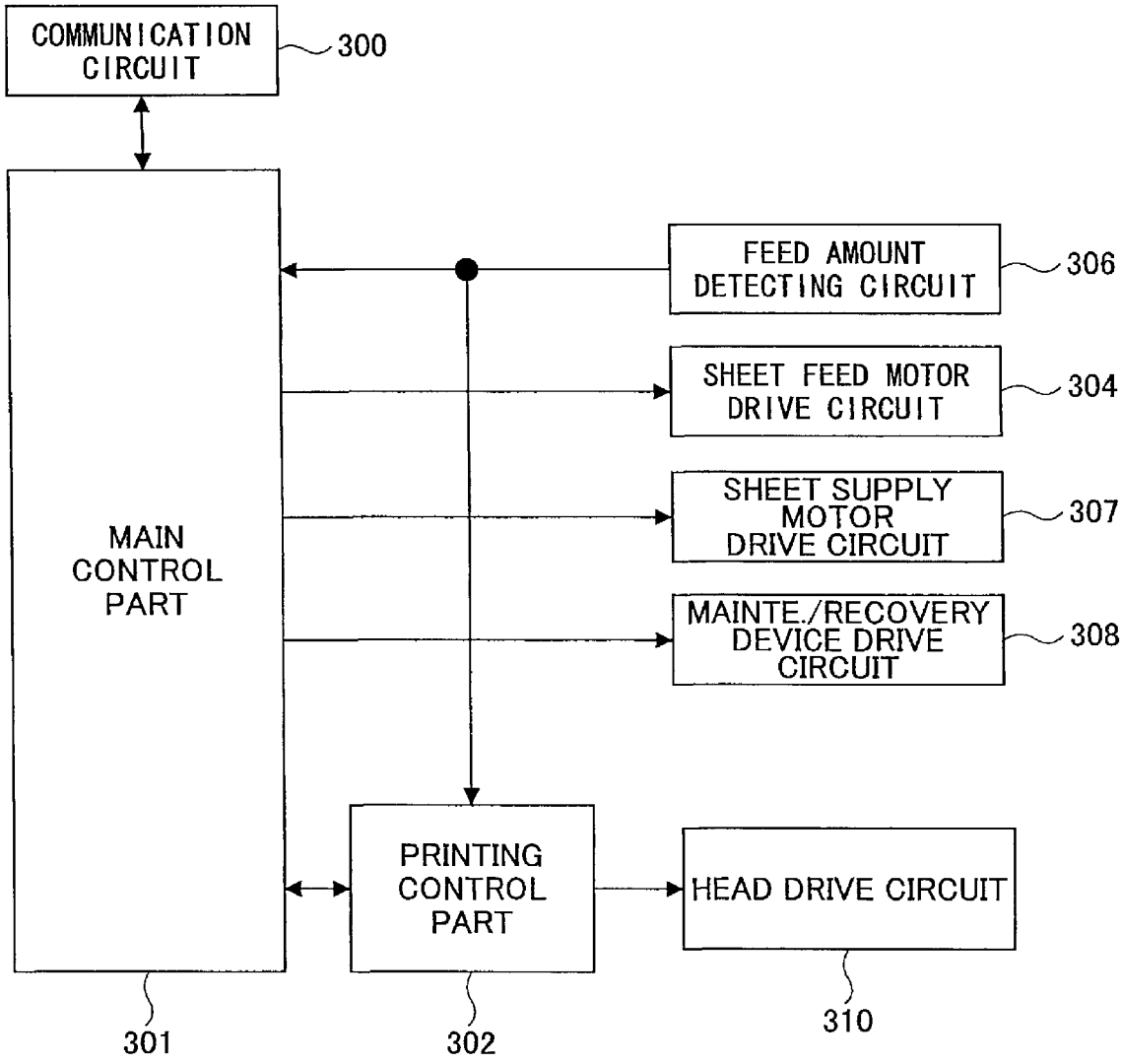
FIG. 5 is a block diagram showing the composition of a control system of the image forming device of FIG. 1.

As shown in FIG. 5, the control system includes a main control part 301 constituted by a microcomputer which controls the entire image forming device and includes a control unit which controls idle discharge operation according to the invention, and a printing control part 302 constituted by a microcomputer which performs printing control.

In order to form an image on a recording sheet based on print processing information received from a communication circuit 300, the main control part 301 carries out various controls including a drive control of the driving roller 23, a drive control of a sheet feed motor (which is not illustrated) through the sheet feed motor drive circuit 304, and a print control of outputting image data and print control data to the printing control part 302.

The main control part 301 receives a detection signal from the feed amount detecting circuit 306 which detects the amount of movement of the driving roller 23. The main control part 301 controls the amount of movement and rotating speed of the driving roller 23 based on the received detection signal.

For example, the feed amount detecting circuit 306 detects the amount of movement of the driving roller 23 by reading the number of slits of a rotary encoder sheet attached to the rotating shaft of the driving roller 23, using a photosensor, and measuring the amount of movement.

The sheet feed motor drive circuit 304 rotates the sheet feed motor in accordance with the amount of feed received from the main control part 301, so that the driving roller 23 is rotated and a recording sheet is transported to a predetermined position at a predetermined speed.

The main control part 301 performs one revolution of the sheet supply roller 21 by outputting a sheet-supply motor drive command to the sheet-supply motor drive circuit 307. The main control part 301 performs the maintenance recovery action of the recording head 11 by driving the drive source of the head holder (not illustrated) and driving the maintenance/recovery device 12 through the maintenance/recovery-device drive circuit 308.

The printing control part 302 generates, based on the amount of sheet feed from the feed amount detecting circuit 306 and the control signal from the main control part 301, the drive waveform data for driving the energy generating unit (piezoelectric elements) of the recording head 11 to discharge liquid drops, and transmits the drive waveform data to the head drive circuit 310. The printing control part 302 outputs various signals required for transmission of image data and acknowledgement of the transmission, to the head drive circuit 310.

The printing control part 302 includes a drive waveform generating part which is constituted by a D-A converter for D/A conversion of the drive signal pattern data stored in ROM, a voltage amplifier, a current amplifier etc., and a drive waveform selecting unit which selects a drive signal to be supplied to the head drive circuit 310. The printing control part 302 generates a drive waveform containing one or a plurality of drive pulses (drive signals), and outputs the drive waveform to the head drive circuit 310.

The head drive circuit 310 selects the drive signal from the drive waveform received from the printing control part 302 in accordance with the image data, and supplies the drive signal to the energy generating unit (piezoelectric elements) of the recording head 11, so that the energy generating unit (piezoelectric elements) of the recording head 11 is driven to generate energy to discharge liquid drops.

Next, a description will be given of the printing control part 302 and the head drive circuit 310 with reference to FIG. 6.

Figure 6:
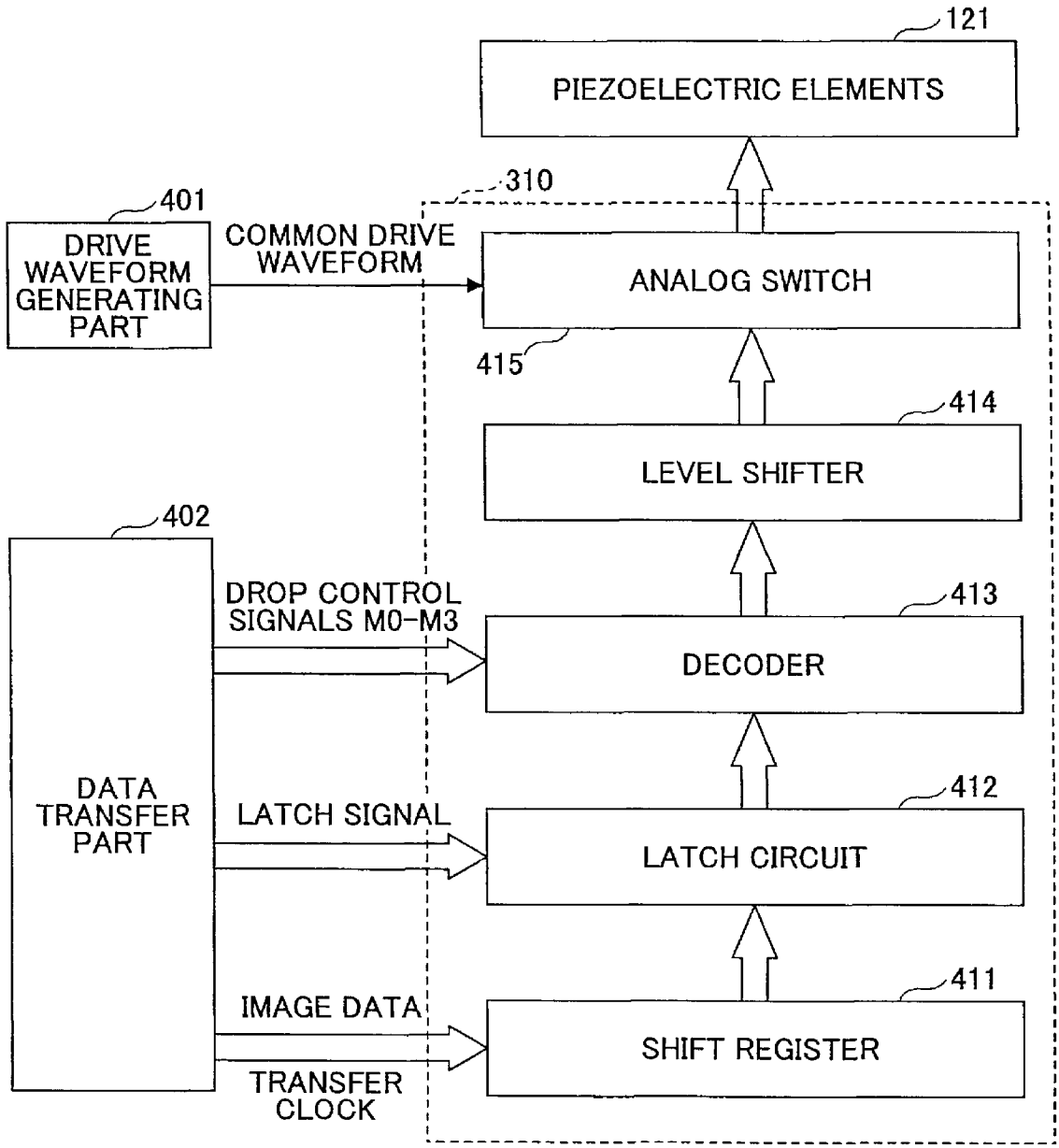
FIG. 6 is a block diagram showing the composition of a printing control part and a head drive circuit in the control system of FIG. 5.

As shown in FIG. 6, the printing control part 302 includes: a drive waveform generating part 401 which generates the drive waveform (common drive waveform) containing a plurality of drive pulses (drive signals) within one printing cycle; and a data transfer part 402 which outputs, to the head drive circuit 310, 2-bit image data (gradation signals 0 and 1) according to the print image, a clock signal, a latch signal (LAT), and drop control signals M0-M3.

The drop control signals M0-M3 are supplied to the head drive circuit 310 for requesting, for every drop, switching ON and OFF of the analog switch 415 (which is a switching unit in the head drive circuit 310). The state of each drop control signal is shifted to H level (ON) in accordance with the printing cycle of the common drive waveform when any portion of the waveform should not be selected, and the state of each drop control signal is shifted to L level (OFF) when a portion of the waveform should be selected.

The head drive circuit 310 includes the following elements: a shift register 411 which receives a transfer clock (shift clock) and serial image data (gradation data: 2 bits per channel) from the data transfer part 402; a latch circuit 412 for latching each registration value of the shift register 411 using the latch signal from the data transfer part 402; a decoder 413 which decodes the gradation data and the drop control signal M0-M3 and outputs the resulting data; a level shifter 414 which converts the logic-level voltage signal of the decoder 413 into the level on which an analog switch 415 can operate; and an analog switch 415 which is switched on and off in accordance with the output of the decoder 413 received via the level shifter 414.

The analog switch 415 is connected to a selection electrode (individual electrode) 154 of each piezoelectric element 121, and the common drive waveform from the drive waveform generating part 401 is supplied to the analog switch 415.

When the analog switch 415 is switched ON based on the image data (gradation data) transferred serially and the resulting data of the control signals M0-M3 from the decoder 413, the drive signal which is selected from the common drive waveform is supplied to the piezoelectric element 121.

Next, the drive waveform in an embodiment of the invention will be described with reference to FIG. 7.

Figure 7:
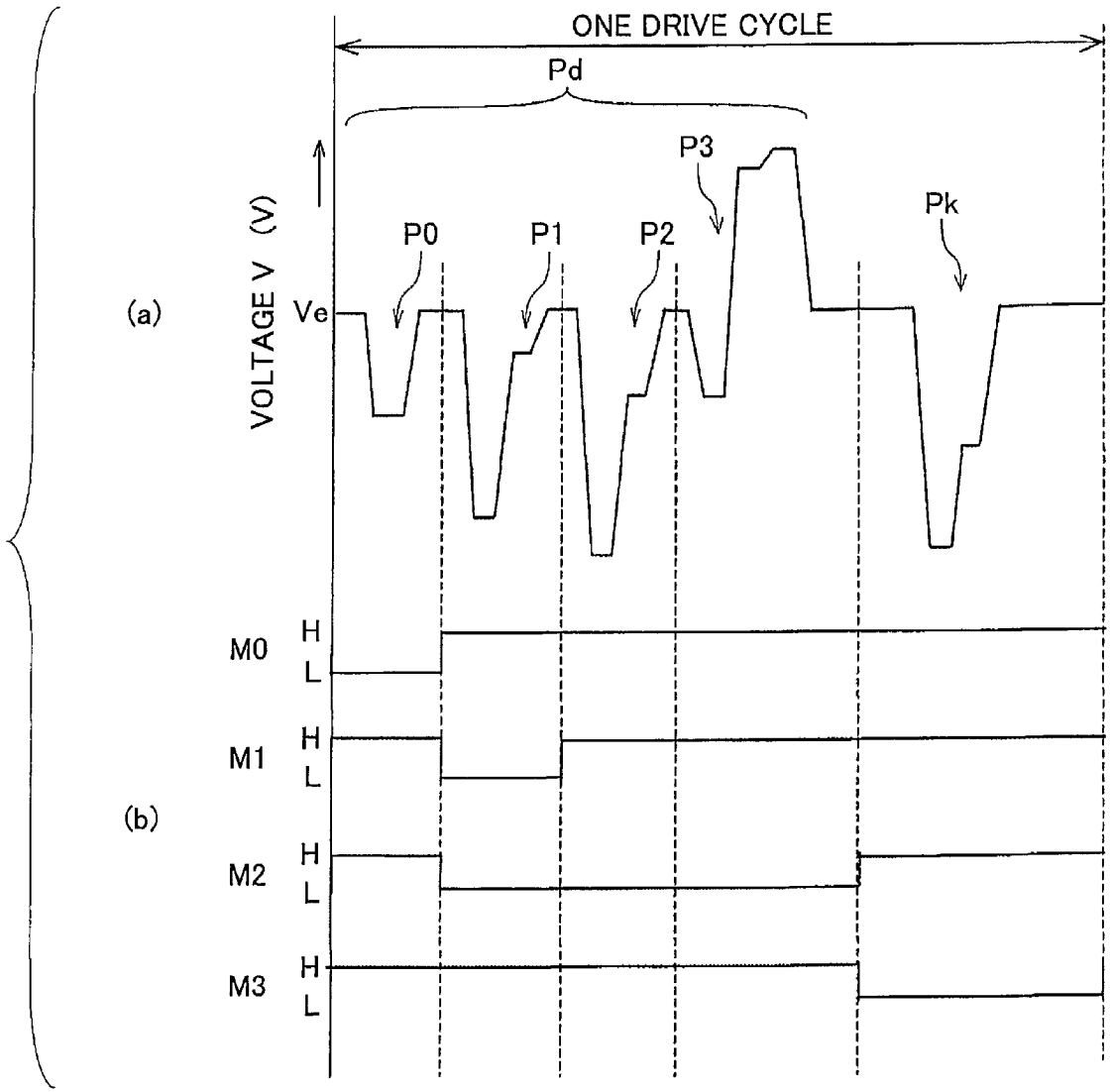
FIG. 7 is a diagram showing an example of a drive waveform which is generated by the control system of FIG. 5.

As shown in FIG. 7 (*a*), the drive waveform generating part 401 generates, within one drive cycle (one printing cycle) that is determined by the pixel density and the recording sheet transport speed, a drive waveform containing a first drive waveform Pd and a second drive waveform Pk in time series.

The first drive waveform Pd includes a non-discharge drive signal P0 for oscillating the meniscus of the nozzle which is not used for image formation, and a plurality of first discharge drive signals (drive pulses) P1-P3 for discharging the amount of liquid drop used for image formation. The second discharge drive signal (the second drive waveform) Pk is to discharge the amount of liquid drop smaller than the minimum discharge drop amount used for image formation.

Alternatively, the second drive waveform may be arranged to include a plurality of second discharge drive signals similar to the first drive waveform.

Each of the drive signals P0-P3 and Pk includes a waveform element whose voltage falls from the reference voltage Ve, and a waveform element whose voltage rises from the low potential to which the voltage has fallen.

The waveform element in which the voltage V of the drive signal falls from the reference voltage Ve is called a drawing waveform element, and this waveform element causes the piezoelectric element 121 to contract and causes the capacity of the liquid chamber 106 to expand.

The waveform element whose voltage rises from the low potential to which the voltage has fallen is called a pressing waveform element, and this waveform element causes the piezoelectric element 121 to elongate and causes the capacity of the liquid chamber 106 to contract.

The drive signal P0 included in the first drive waveform Pd is a drive waveform which oscillates the meniscus of the nozzle without making liquid drop discharge. Each of the drive signals P1-P3 and Pk included in the first and second drive waveforms is a drive waveform for discharging a liquid drop by expanded the liquid chamber communicating with the nozzle of the liquid discharge head, and thereafter shrinking the liquid chamber.

One of the drop control signals M0-M3 shown in FIG. 7 (*b*) is supplied from the data transfer part 402 to the head drive circuit 310. The head drive circuit 310 performs the drive signal selection to select at least one of the drive signal in the first drive waveform and the drive signal in the second drive waveform in the received drop control signal.

For example, when performing a fine drive, the drive signal P0 is selected in response to the drop control signal M0 (selection is done by the L level state of the drop control signal). When discharging a small drop, the drive signal P1 is selected in response to the drop control signal M1. When discharging a large drop, the drive signals P1-P3 are selected in response to the drop control signal M2. When performing idle discharge, the drive signal Pk is selected in response to the drop control signal M3. The selected drive signal is supplied to the piezoelectric element 121 of the recording head 11, respectively.

In this example, one of the two drop sizes: small drop and large drop is selected. Alternatively, one of three drop sizes: small drop, middle drop, and large drop may be selected to discharge the selected drop.

An example of the first discharge drive signal P1 for discharging a small drop, and the second discharge drive signal Pk for performing idle discharge will be described with reference to FIG. 8A and FIG. 8B.

Figure 8B:
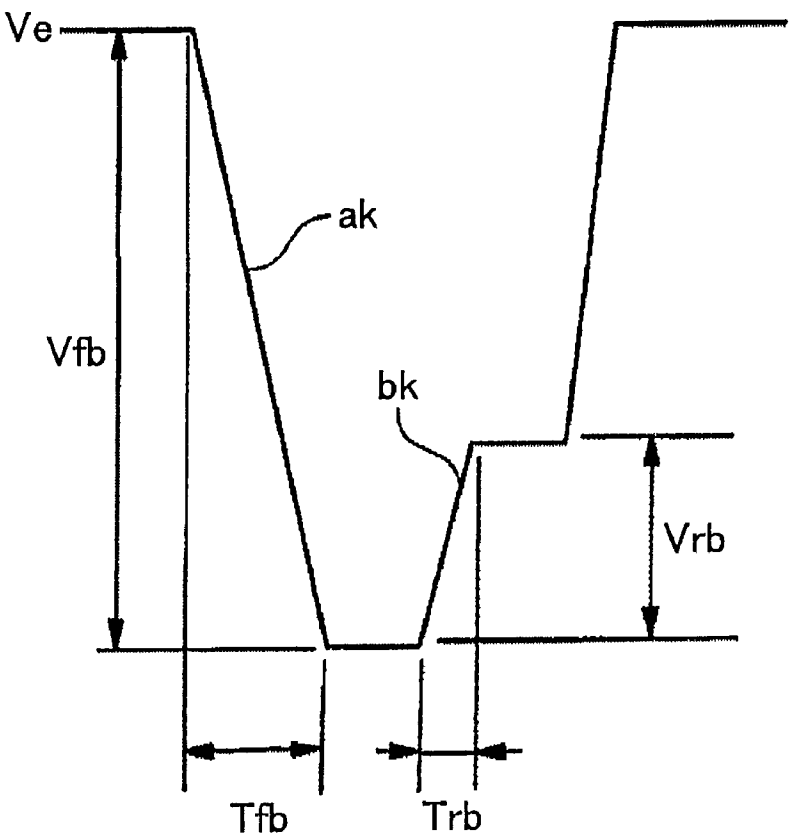
FIG. 8B is a diagram showing an example of a drive signal Pk which is included in a second drive waveform that constitutes a part of the drive waveform of FIG. 7.
Figure 8A:
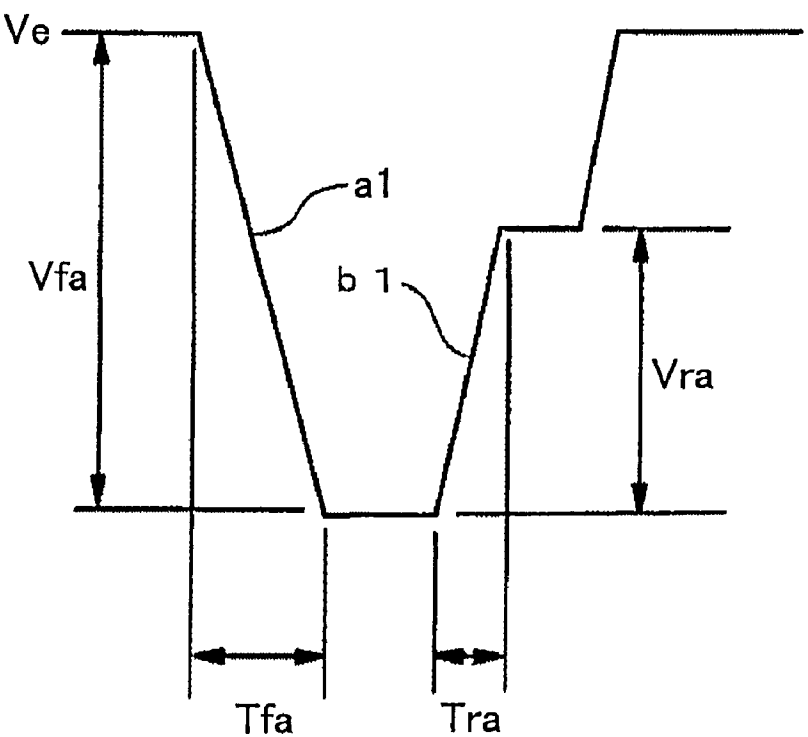
FIG. 8A is a diagram showing an example of a drive signal P1 which is included in a first drive waveform which constitutes a part of the drive waveform of FIG. 7.

FIG. 8A shows an example of the first discharge drive signal P1 in the first drive waveform Pd for discharging a small drop (a minimum liquid drop used for image formation).

FIG. 8B shows an example of the second discharge drive signal Pk in the second drive waveform for discharging the amount of liquid drop smaller than the minimum discharge drop amount.

The drive signal P1 includes a drawing waveform element a1 whose voltage falls from the reference voltage Ve by a voltage change Vfa, causing the liquid chamber 106 to expand, and causing the meniscus of the nozzle to be drawn.

After a predetermined hold time, the drive signal P1 includes a pressing waveform element b1 whose voltage rises by a voltage change Vra, shrinking the liquid chamber 106 and discharging a liquid drop from the nozzle. After a predetermined hold time, the voltage of the drive signal P1 rises to the reference voltage Ve.

The drive signal Pk includes a drawing waveform element ak whose voltage falls from the reference voltage Ve by a voltage change Vfb, causing the liquid chamber 106 to expand and causing the meniscus of the nozzle to be drawn.

After a predetermined hold time, the drive signal Pk includes a pressing waveform element bk whose voltage rises by a voltage change Vrb, shrinking the liquid chamber 106 and discharging a liquid drop from the nozzle. After a predetermined hold time, the voltage of the drive signal Pk rises to the reference voltage Ve.

It is preferred that the timing of shrinking the liquid chamber 106 by the rising edges of the pressing waveform elements b1 and bk accords with the timing of the period of natural resonance arising when expanding the liquid chamber 106 by the falling edges of the drawing waveform elements a1 and ak.

In this embodiment, a change time (falling time) Tfa of the drawing waveform element a1 of the drive signal P1 is equal to a change time (falling time) Tfb of the drawing waveform element ak of the drive signal Pk, and a change time (rising time) Tra of the pressing waveform element b1 of the drive signal P1 is equal to a change time (rising time) Trb of the pressing waveform element bk of the drive signal Pk.

In this embodiment, the rising voltage (voltage change) Vrb of the pressing waveform element bk of the drive signal Pk is set up to be smaller than the rising voltage (voltage change) Vra of the pressing waveform element b1 of the drive signal P1. Thereby, the amount of the liquid drop discharged by the drive signal Pk is smaller than the discharge of the liquid drop (small drop) discharged by the drive signal P1.

Moreover, in this embodiment, the falling voltage (voltage change) Vfb of the drawing waveform element ak of the drive signal Pk is set up to be larger than the falling voltage (voltage change) Vfa of the drawing waveform element a1 of the drive signal P1. Thereby, the drop speed by the drive signal Pk is increased, and it is possible to discharge a liquid drop from the nozzle certainly.

Discharge bending of the liquid drop discharged by the drive signal Pk may arise if a high frequency drive is performed, and the drive signal Pk is not suitably used as a drive signal for discharging a liquid drop used for image formation.

In this embodiment, each of the first and second drive waveforms contains the pressing waveform element which discharges a liquid drop by shrinking the liquid chamber communicating with the nozzle of the liquid discharge head. The voltage change of the pressing waveform element of the drive signal included in the second drive waveform is set up to be smaller than the voltage change of the pressing waveform element of the drive signal included in the first drive waveform, thereby discharging the amount of liquid drop smaller than the minimum discharge drop amount used for image formation.

Moreover, in this embodiment, each of the first and second drive waveform contains the drawing waveform element which expands the liquid chamber communicating with the nozzle of the liquid discharge head. The voltage change of the drawing waveform element of the drive signal included in the second drive waveform is set up to be larger than the voltage change of the drawing waveform element of the drive signal included in the first drive waveform, thereby increasing the discharge drop speed and discharging certainly the amount of liquid drop smaller than the minimum discharge drop amount used for image formation.

Next, another example of the drive signal P1 for discharging a small drop, and the drive signal Pk for performing idle discharge will be described with reference to FIG. 9A and FIG. 9B.

Figure 9B:
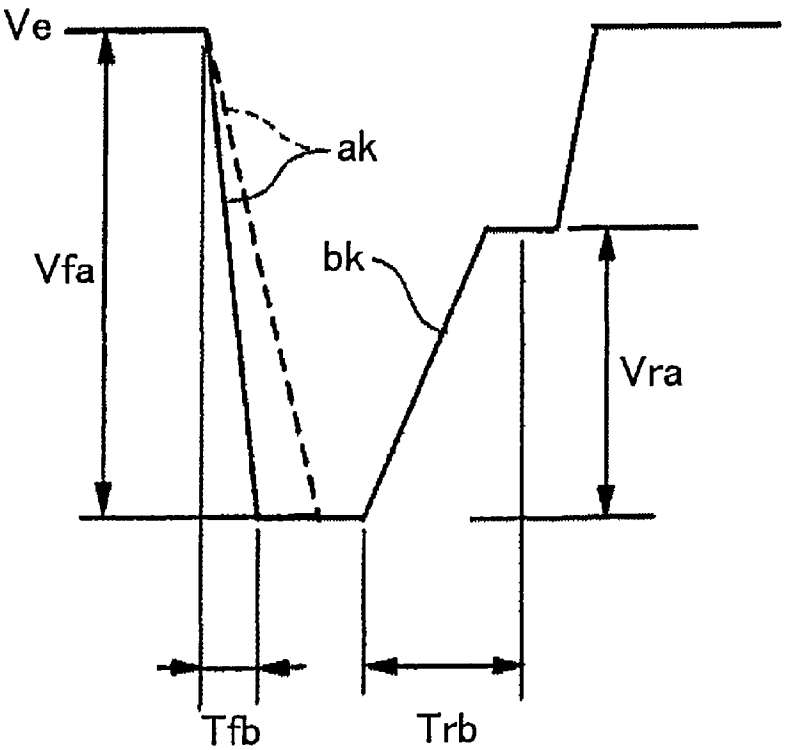
FIG. 9B is a diagram showing an example of a drive signal Pk which is included in a second drive waveform that constitutes a part of the drive waveform of FIG. 7.
Figure 9A:
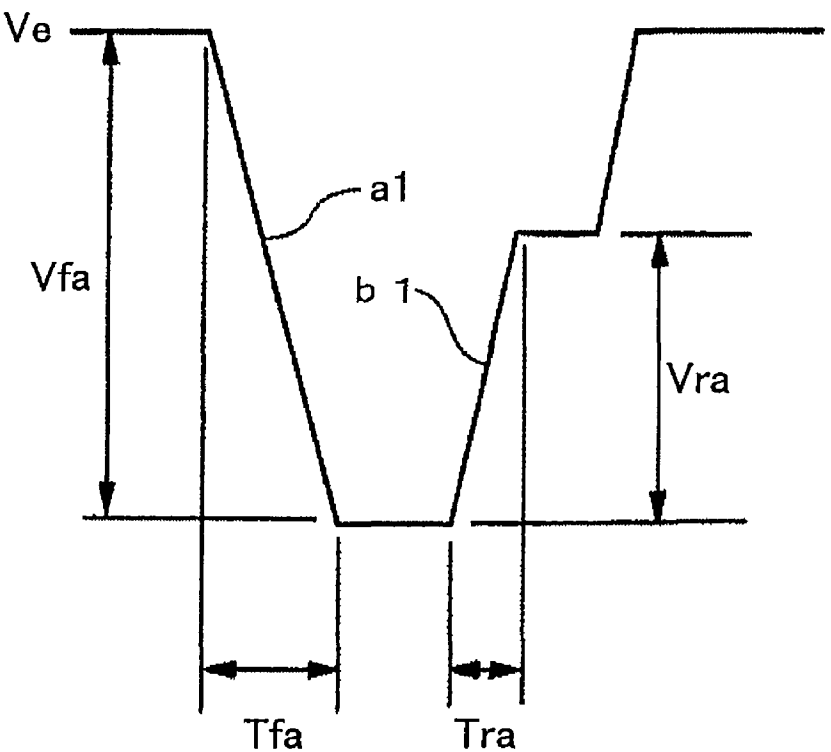
FIG. 9A is a diagram showing an example of a drive signal P1 which is included in a first drive waveform which constitutes a part of the drive waveform of FIG. 7.

FIG. 9A shows the waveform of a drive signal P1 in the first drive waveform Pd for discharging the minimum discharge drop amount (a small drop) used for image formation.

FIG. 9B shows the waveform of a drive signal Pk in the second drive waveform for discharging the amount of liquid drop (a very small drop) smaller than the minimum discharge drop amount.

As shown in FIGS. 9A and 9B, the drive signals P1 and Pk include drawing waveform elements a1 and ak whose voltage falls from the reference voltage Ve by a voltage change Vfa, respectively, causing the liquid chamber 106 to expand and causing the meniscus of the nozzle to be drawn. After a predetermined hold time, the drive signals P1 and Pk include pressing waveform elements b1 and bk whose voltage rises by a voltage change Vra, shrinking the liquid chamber 106 and discharging a liquid drop from the nozzle. After a predetermined hold time, the voltage of the drive signals P1 and Pk rises to the reference voltage Ve.

In this example, the falling times (change times) Tfa and Tfb of the drawing waveform elements a1 and ak are set up to be different from each other, and the rising times (change times) Tra and Trb of the pressing waveform elements b1 and bk are set up to be different from each other.

Specifically, the falling time Tfb of the drawing waveform element ak of the drive signal Pk is set up to be smaller than the falling time Tfa of the drawing waveform element a1 of the drive signal P1. The rising time Trb of the pressing waveform element bk of the drive signal Pk is set up to be larger than the rising time Tra of the pressing waveform element b1 of the drive signal P1.

It is preferred that the timing of shrinking the liquid chamber 106 by the rising edges of the pressing waveform elements b1 and bk accords with the timing of the period of natural resonance arising when expanding the liquid chamber 106 by the falling edges of the drawing waveform elements a1 and ak.

In this example, the rising time (change time) Trb of the pressing waveform element bk of the drive signal Pk is set up to be larger than the rising time (change time) Tra of the pressing waveform element b1 of the drive signal P1. Thereby, the amount of the liquid drop discharged by the drive signal Pk is smaller than the amount of the liquid drop (small drop) discharged by the drive signal P1.

Moreover, in this example, the falling time (change time) Tfb of the drawing waveform element ak of the drive signal Pk is set up to be smaller than the falling time (change time) Vfa of the drawing waveform element a1 of the drive signal P1. Thereby, the drop discharge speed by the drive signal Pk is increased, and it is possible to discharge a liquid drop from the nozzle certainly.

Discharge bending of the liquid drop discharged by the drive signal Pk may arise if a high frequency drive is performed, and the drive signal Pk is not suitably used as a drive signal for discharging a liquid drop used for image formation.

In this embodiment, each of the first and second drive waveform contains the pressing waveform element which discharges a liquid drop by shrinking the liquid chamber communicating with the nozzle of the liquid discharge head. The change time of the pressing waveform element of the drive signal included in the second drive waveform to discharge the amount of liquid drop smaller than the minimum discharge drop amount used for image formation is larger than the change time of the pressing waveform element of the drive signal included in the first drive waveform to discharge the amount of liquid drop used for image formation, and the amount of liquid drop smaller than the minimum discharge drop amount used for image formation is discharged from the nozzle.

Moreover, in this embodiment, each of the first and second drive waveforms contains the drawing waveform element which expands the liquid chamber communicating with the nozzle of the liquid discharge head. The change time of the drawing waveform element of the drive signal included in the second drive waveform to discharge the amount of liquid drop smaller than the minimum discharge drop amount used for image formation is smaller than the change time of the drawing waveform element of the drive signal included in the first drive waveform to discharge the amount of liquid drop used for image formation. Thus, the discharge drop speed during idle discharge is increased, and it is possible to discharge certainly the amount of liquid drop smaller than the minimum discharge drop amount used for image formation.

Moreover, in the example of FIG. 9B, the falling time Tfb of the drive signal Pk may be set up to be the same as the falling time Tfa of the drive signal P1 by modifying the slope of the drawing waveform element ak to be gentle as indicated by the dotted line in FIG. 9B. In such a case, the discharge drop speed and the drop discharge amount by the drive signal Pk are smaller than those of the liquid drop (the minimum discharge drop amount used for image formation) by the drive signal P1.

If the discharge drop speed of the amount of liquid drop smaller than the minimum discharge drop amount used for image formation is smaller than that of the liquid drop of the minimum discharge used for image formation, the liquid drop by idle discharge may not reach the recording sheet. However, the purpose of idle discharge is to perform maintenance and recovery of the nozzle by discharging a liquid drop therefrom. It is not necessary that the liquid drop by idle discharge reaches the recording sheet.

Next, the idle discharge control performed by the image forming device of this embodiment will be described with reference to the flowchart of FIG. 10.

Figure 10:
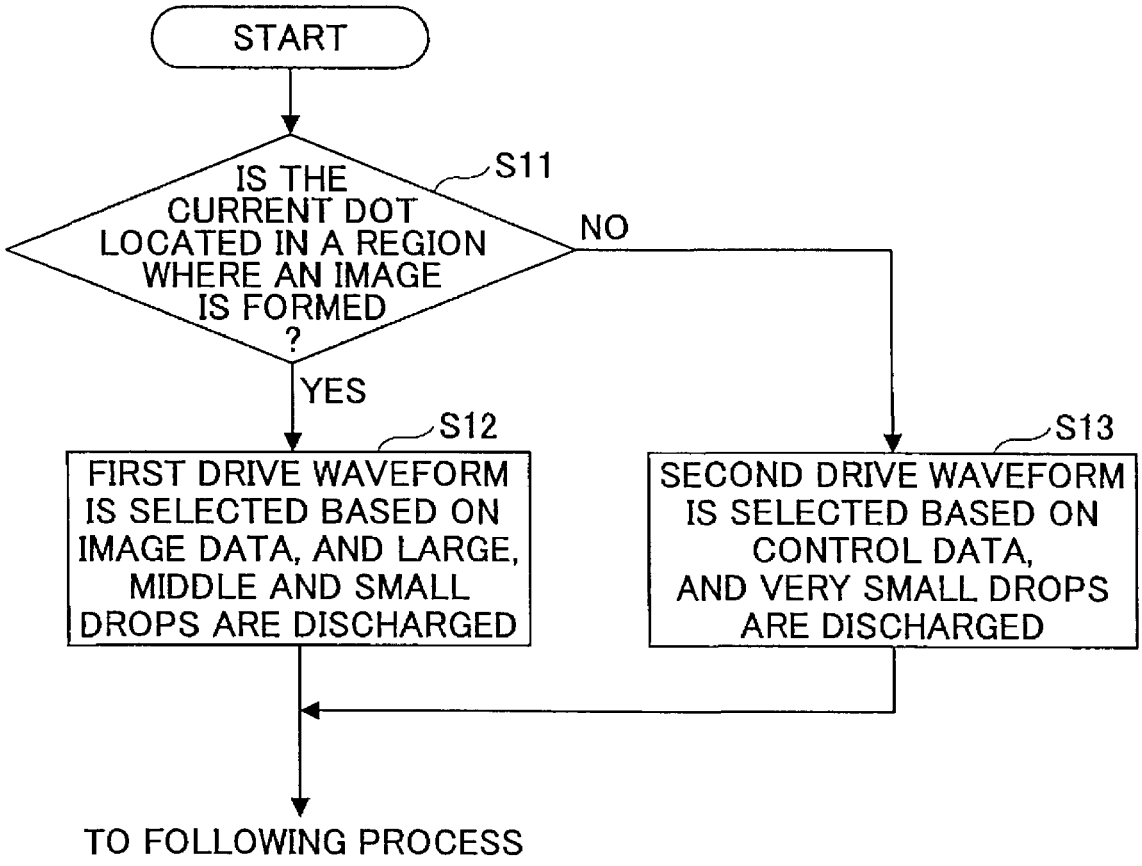
FIG. 10 is a flowchart for explaining a liquid drop discharge control which is performed by the image forming device of FIG. 1.

Upon start of the idle discharge control of FIG. 10, it is determined whether the current dot (pixel) is located in a region where an image is formed (S11).

When the result of the determination at step S11 is affirmative (located in the region where an image is formed), necessary drive signals P1-P5 are selected from the first drive waveform Pd of the drive waveforms based on the image data so that an image is formed on the medium by discharging liquid drops (large, middle, small) from the recording head (S12).

When the result of the determination at step S11 is negative (not located in the region where an image is formed), the second drive waveform (drive signal) Pk of the drive waveforms is selected based on the control data (for idle discharge) so that an idle discharge operation is performed by discharging very small drops, smaller than the minimum drop used for image formation, from the recording head (S13).

After the step S12 or S13 is performed, the following process will be performed by the image forming device of this embodiment.

Figure 11:
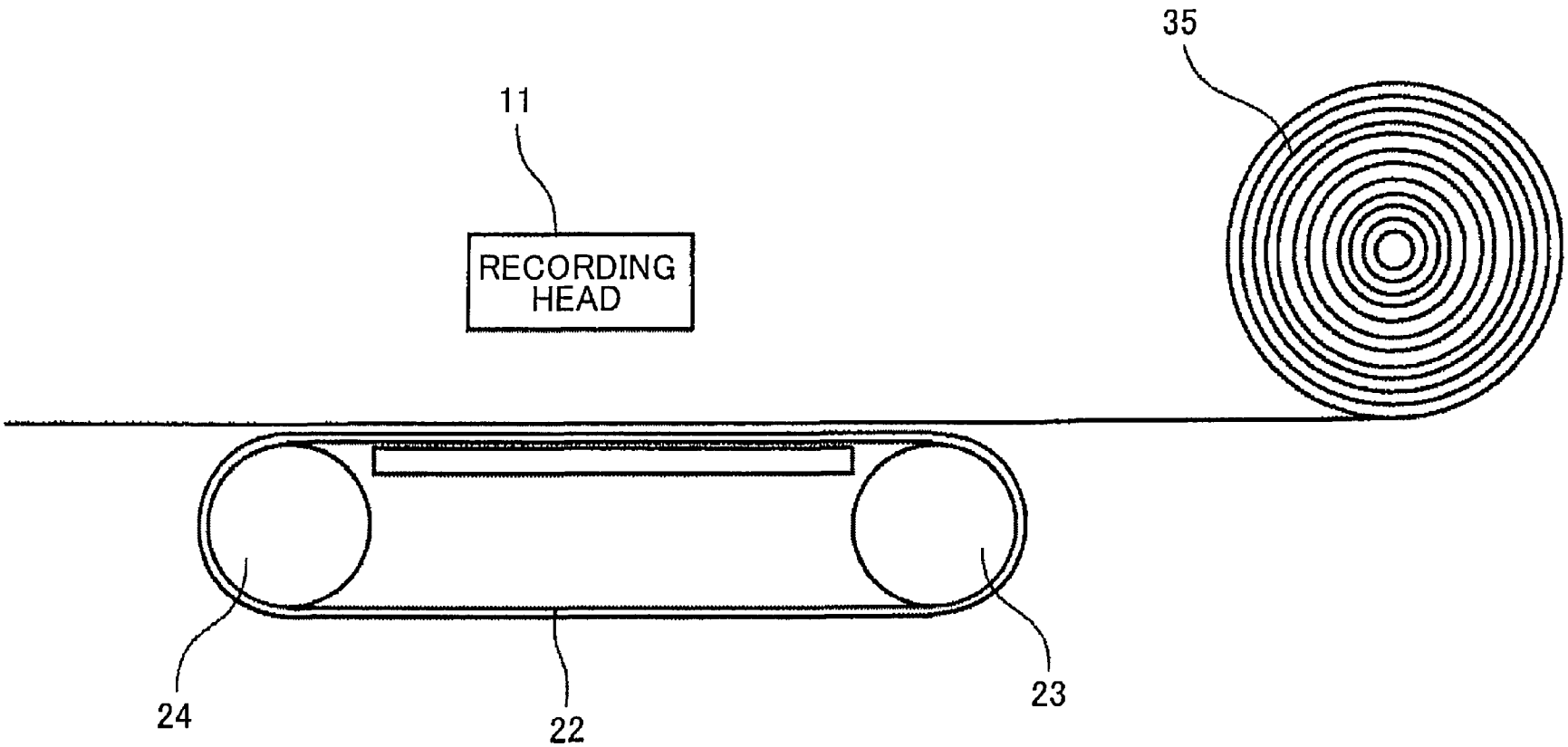
FIG. 11 is a diagram showing an example of the image forming device in which image formation is performed by the recording head using a roll sheet.
Figure 12:
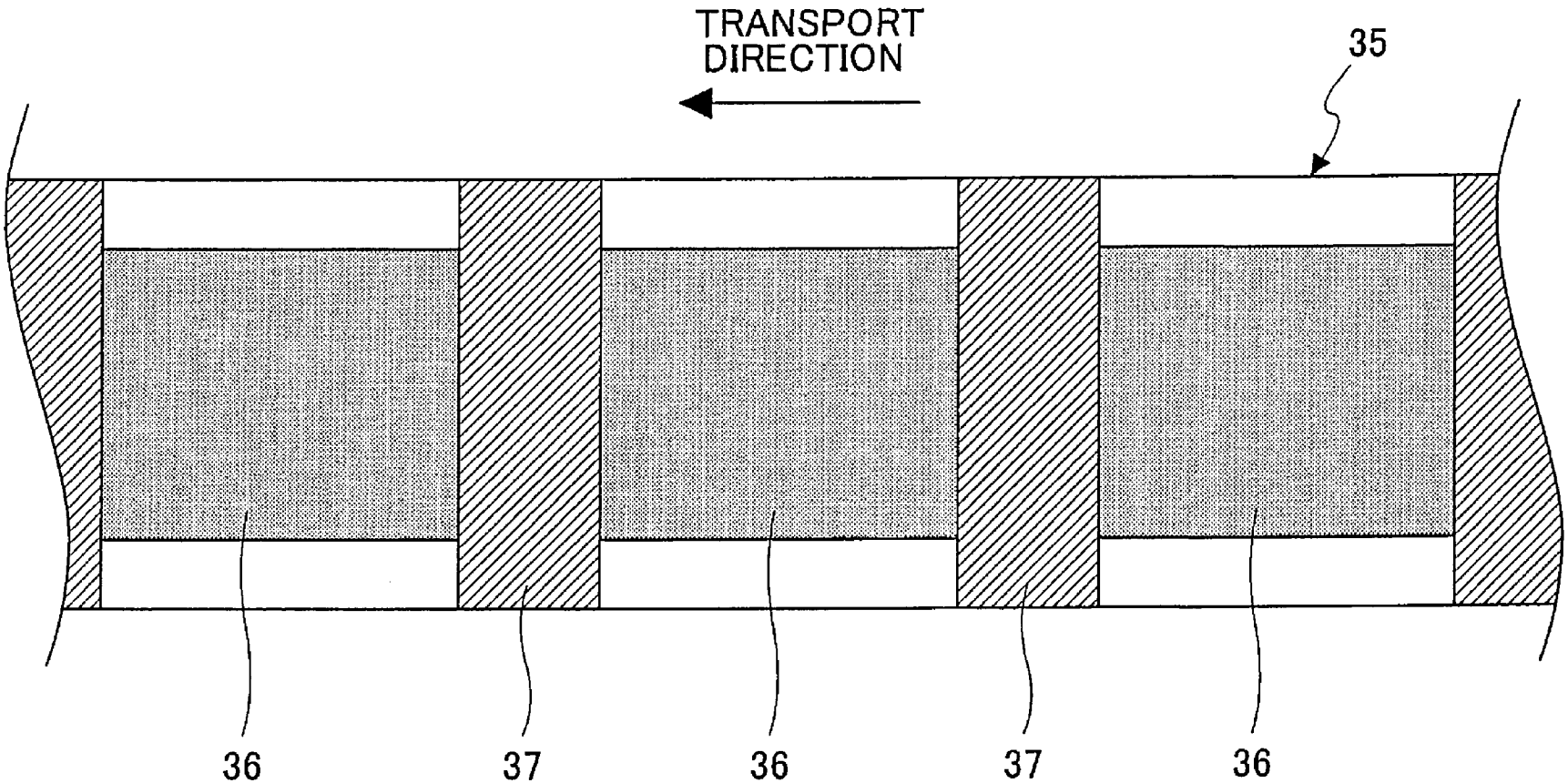
FIG. 12 is a diagram for explaining an example of a region where an image is formed, and a region where any image is not formed.

In a case in which a roll sheet 35 shown in FIG. 11 is used as a medium, a recording region 36 where an image is formed and a non-recording region 37 where any image is not formed alternately appear along a recording sheet transporting direction (sheet feed direction) as shown in FIG. 12. In this case, the liquid discharge head forms a necessary image on the medium for the recording region 36 by discharging the liquid drops (large, middle, small) thereto, and the liquid discharge head performs idle discharge for the non-recording region 37 by discharging very small drops from the nozzle. In this way, it is possible to create a printed matter on which an image is formed by the image forming device of this embodiment. In this case, the non-recording region 37 where any image is not formed corresponds to a region of the medium in which the medium is transported in a transport direction.

Moreover, in this case, when an idle discharge operation is performed for the non-recording region 37 where any image is not formed, the recording head 11 discharges the amount of liquid drop smaller than the minimum discharge drop amount used for image formation, from all of the nozzles of the recording head 11, over an entire image formable region of the medium in the width direction of the medium. This facilitates creation of the idle discharge control data, and it is possible for this embodiment to perform idle discharge operation using a simple, inexpensive mechanism, without degrading the image quality.

Figure 13:
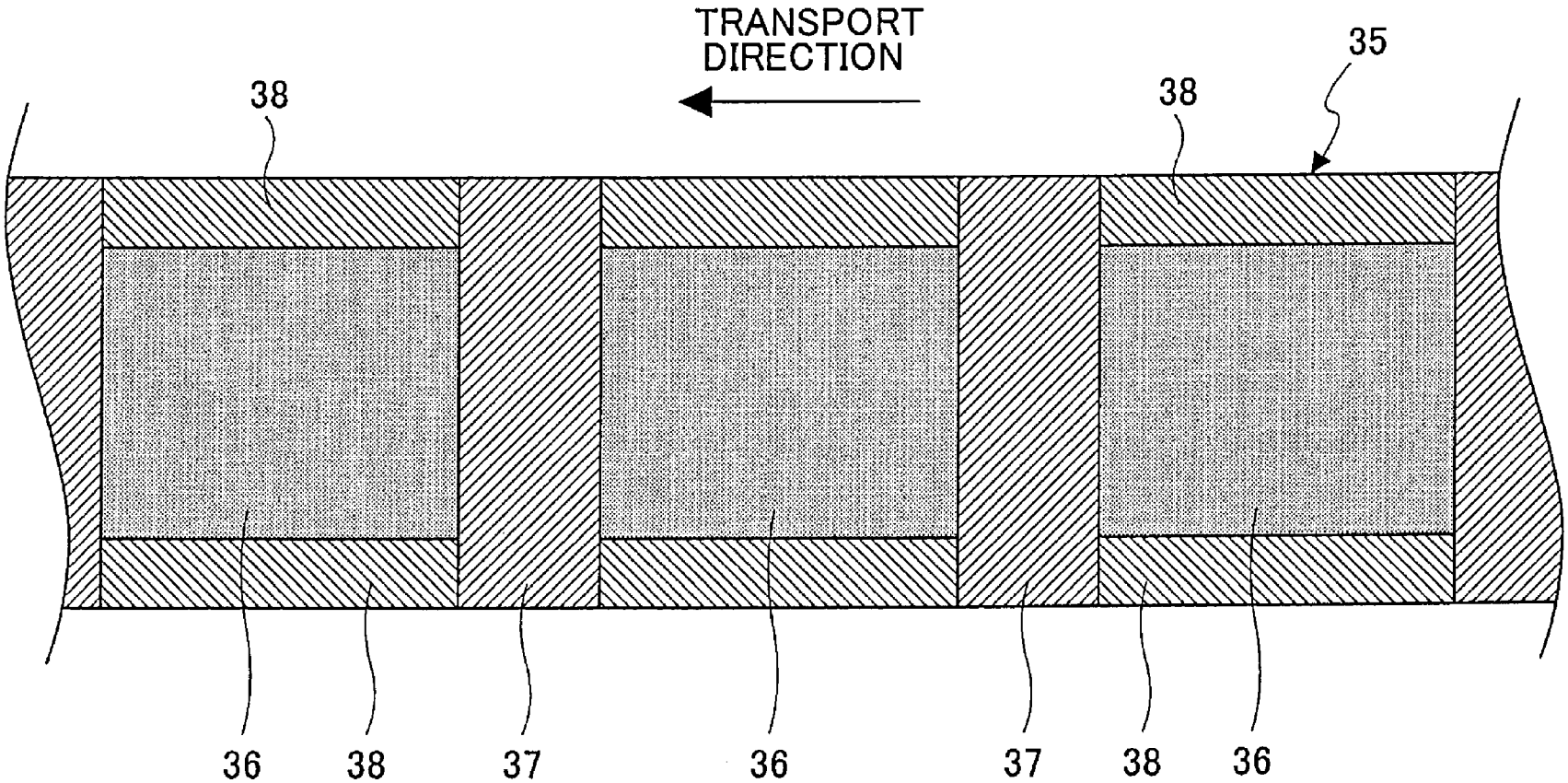
FIG. 13 is a diagram for explaining an example of a region where an image is formed, and a region where any image is not formed.

Moreover, in the case in which the roll sheet 35 is used as a medium (also in a case in which a sheet-like recording medium is used), non-recording regions 38 where any image is not formed appear in both end portions of the recording region 36 in a width direction of the medium perpendicular to a transporting direction in which the medium is transported, as shown in FIG. 13. In this case, the liquid discharge head forms a necessary image on the medium for the recording region 36 by discharging the liquid drops (large, middle, small) thereto, and the liquid discharge head performs idle discharge for the non-recording region 38 by discharging very small drops from the nozzle.

In this case, the region where any image is not formed corresponds to the end portion of the image formation region of the medium in a direction perpendicular to the transporting direction in which the medium is transported.

However, in a case of the image forming device using the full-line type recording head, the nozzles for which idle discharge operation may be performed are restricted if the non-recording region corresponds to the end portion of the recording region in the direction perpendicular to the transporting direction in which the medium is transported. In such a case, idle discharge is no longer performed for the nozzles of the full-line type recording head which are used for image formation. Thus, the image forming device of this embodiment is suitably applied to the serial type image forming device in which the recording head is moved in the width direction perpendicular to the transporting direction.

Figure 14:
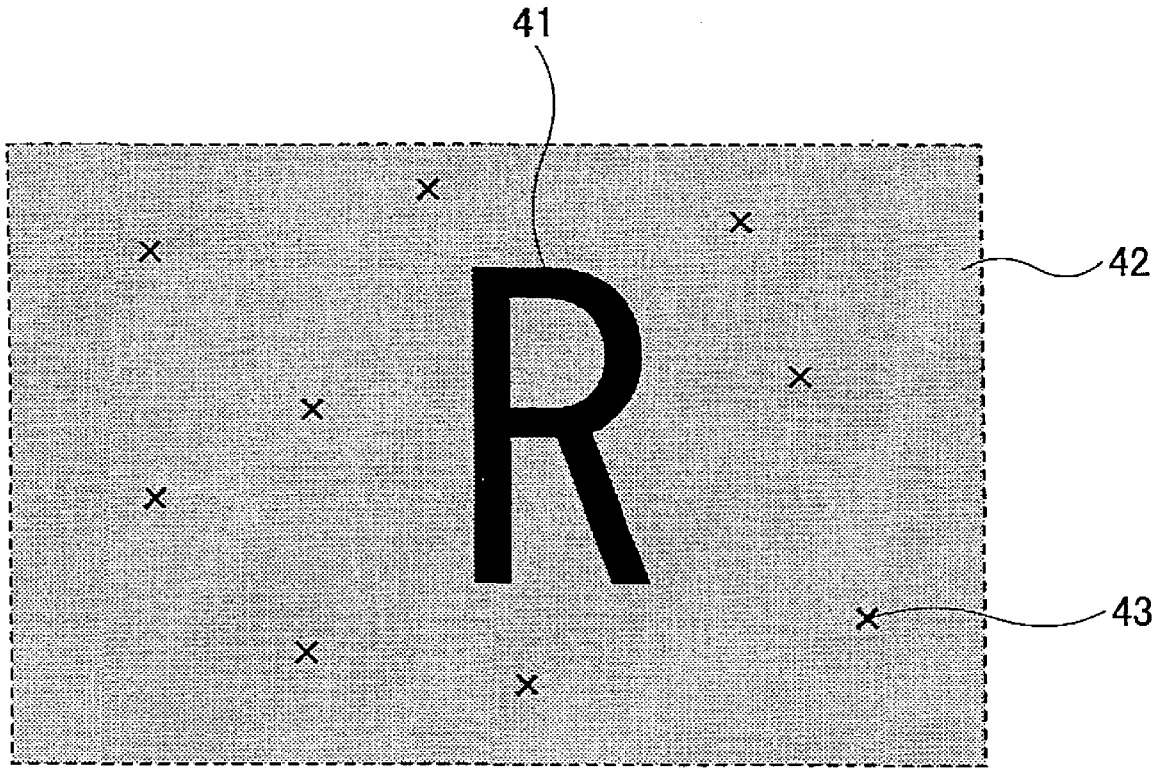
FIG. 14 is a diagram for explaining an example of a region where an image is formed, and a region where any image is not formed.

Moreover, the recording head in the image forming device of this embodiment may be arranged so that the recording region where an image is formed is set to an actual image region 41 where the image is actually formed by discharging liquid drops based on the image data, and the peripheral region, surrounding the actual image region 41, is set to a non-recording region 42 where any image is not formed, as shown in FIG. 14. The recording head in this case may be arranged to perform idle discharge operation for the non-recording region 42 by discharging very small drops 43 thereto.

As described above, it is possible for the image forming device of this embodiment to perform idle discharge operation using a simple, inexpensive mechanism.

Next, the drive waveform in another embodiment of the invention will be described with reference to FIG. 15.

Figure 15:
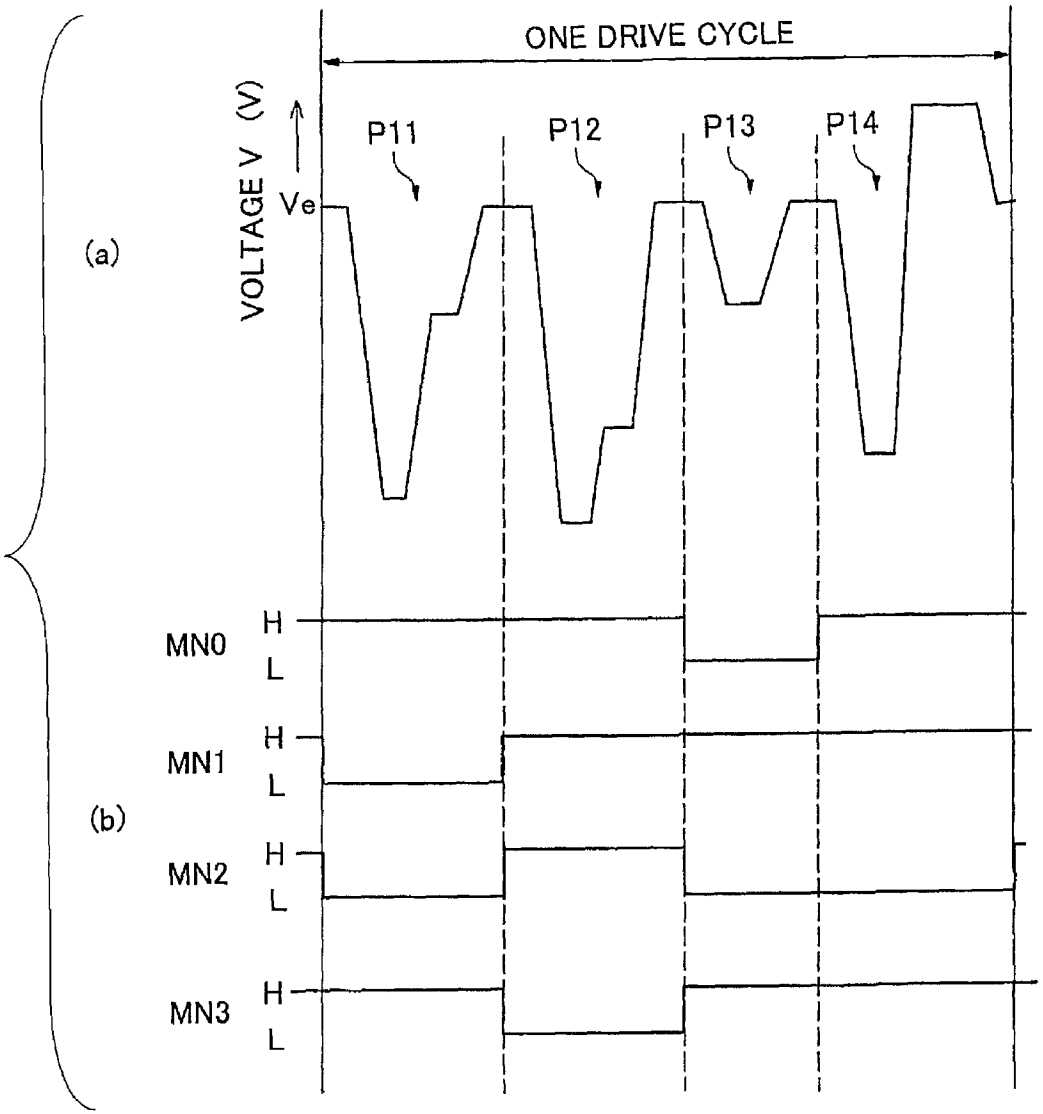
FIG. 15 is a diagram showing an example of a drive waveform which is generated by a control system of an image forming device in an embodiment of the invention.

In this embodiment, the drive waveform shown in FIG. 15 (*a*) is generated and outputted by the drive waveform generating part 401, and any of the drop control signals MN0-MN3 shown in FIG. 15 (*b*) (which are the same as the drop control signals M0-M3 in the previous embodiment) is outputted by the data transfer part 402, so that a necessary drive signal is selected from the drive waveform by the head drive circuit 310 in response to the drop control signal.

The drive waveform shown in FIG. 15 (*a*) includes, within a single drive cycle, a first discharge drive signal P11 for discharging a liquid drop used for image formation, a second discharge drive signal P12 for discharging the amount of liquid drop smaller than the minimum discharge drop amount used for image formation, a non-discharge drive signal P13 for finely oscillating the meniscus of the nozzle without discharging a liquid drop, and a first discharge drive signal P14 for discharging a liquid drop used for image formation, which drive signals are generated in time series. That is, the plurality of the first discharge drive signals P11 and P14 are generated in time series, and the second discharge drive signal P13 is interposed between the first discharge drive signals P11 and P14.

When the drive waveform of FIG. 15 (*a*) is used, the drive signal P13 is selected in response to the drop control signals MN0, the drive signal P11 is selected in response to the drop control signal MN1, the drive signals P11, P13, P14 are selected in response to the drop control signal MN2, and the drive signal P12 is selected in response to the drop control signal MN3.

FIG. 16 shows the relationship between the drop control signals MN0-MN3 and the discharge drop amount when the selected drive signal is supplied to the energy generating unit of the recording head.

As shown in FIG. 16, when performing a fine drive, the drive signal P13 is selected in response to the drop control signal MNO. When discharging a small dot, the drive signal P 11 is selected in response to the drop control signal MN1. When discharging a large drop, the drive signals P11, P13, P14 are selected in response to the drop control signal MN2. When performing idle discharge, the drive signal P12 is selected in response to the drop control signal MN3. The selected drive signal is supplied to the piezoelectric element 121 of the recording head 11, respectively.

As described above, the plurality of the first discharge drive signals are generated in time series, and the second discharge drive signal is interposed between two of the plurality of the first discharge drive signals.

Next, the drive waveform in another embodiment of the invention will be described with reference to FIG. 17.

In the previously described embodiment, the second discharge drive signal (Pk, P12) is not selected when performing image formation. However, in this embodiment, the second discharge drive signal is selected concurrently with the first discharge drive signal when performing image formation.

Figure 17:
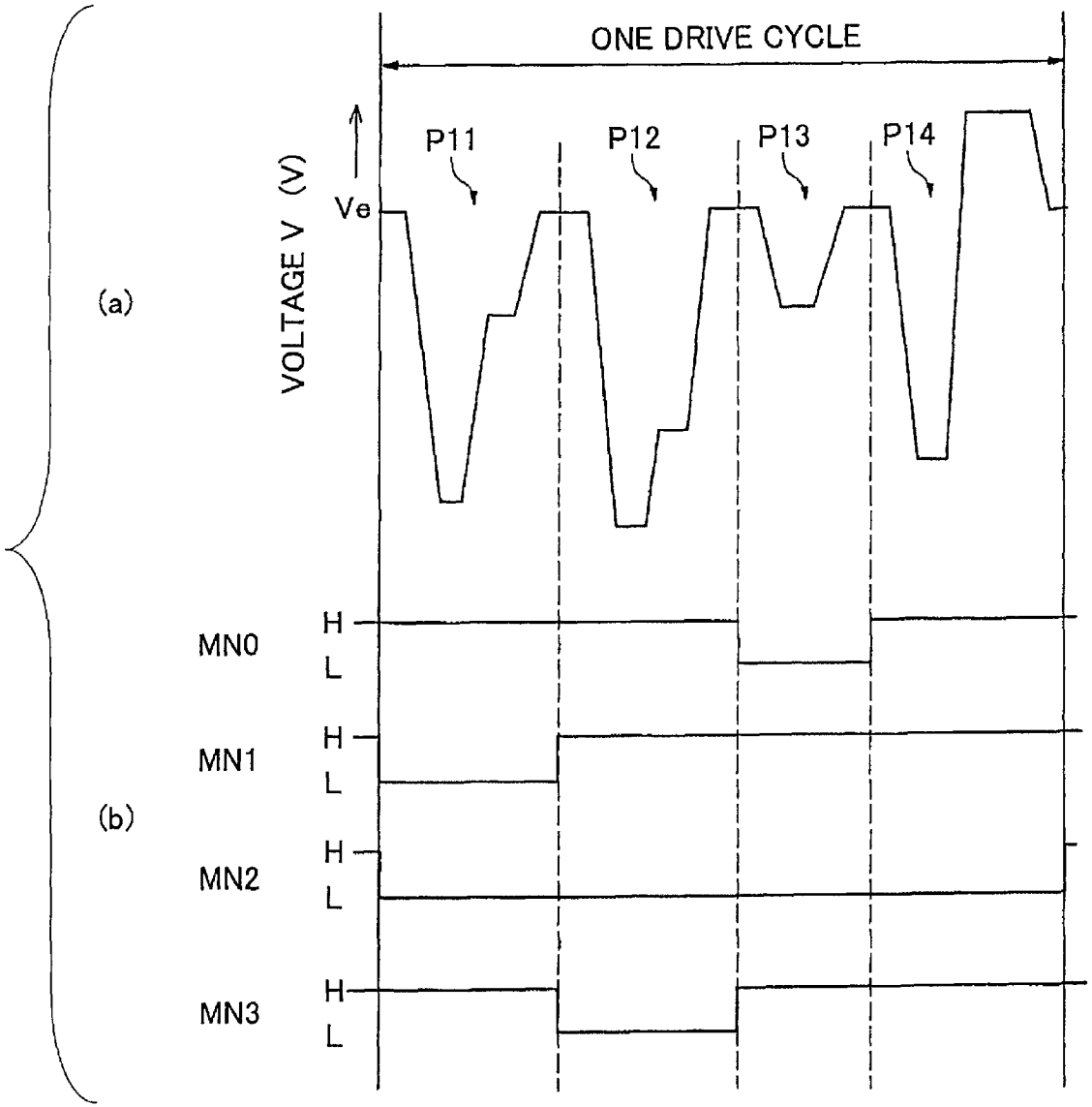
FIG. 17 is a diagram showing an example of a drive waveform which is generated by a control system of an image forming device in an embodiment of the invention.

As shown in FIG. 17 (*b*) and FIG. 18, the drop control signal MN2 for discharging a large drop is arranged so that the second discharge drive signal P12 is also selected and the selected drive signal is supplied to the piezoelectric element 121 of the recording head 11.

Although a liquid drop is discharged by the second discharge drive signal P12 at this time, the speed of a liquid drop subsequently discharged by the first drop discharge drive signal P14 is larger than the speed of the drop by the second discharge drive signal P12. The two dots are united during flight and the influence is not so large. This may be considered that the amount of a large drop discharged in response to the drop control signal MN2 includes the amount of liquid drop discharged by the second discharge drive signal P12.

According to this embodiment, the setting of the drop control signal can be made simple, and it is not necessary to repeat switching ON and OFF of the drop control signal MN2.

Next, another example of the second discharge drive signal will be described with reference to FIG. 19.

Figure 19:
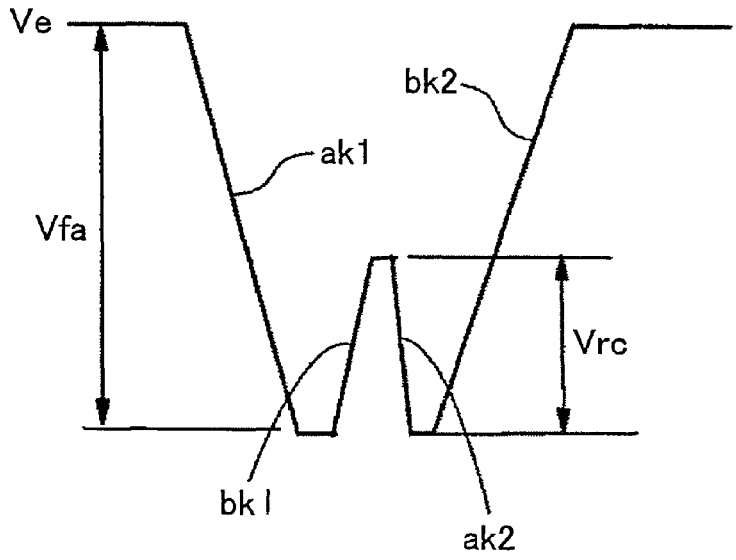
FIG. 19 is a diagram showing an example of a second discharge drive signal to cause the recording head to perform idle discharge.

As shown in FIG. 19, the second discharge drive signal Pk includes a drawing waveform element ak1 whose voltage falls from the reference voltage Ve by a voltage change Vfa to expand the liquid chamber 106 and draw the meniscus of the nozzle. After a predetermined hold time, the drive signal Pk includes a pressing waveform element bk1 whose voltage rises by a voltage change Vrc to shrink the liquid chamber 106 and discharge a liquid drop from the nozzle. The drive signal Pk includes a drawing waveform element ak2 whose voltage falls again to expand the pressurized liquid chamber 106 and tear off a part of the discharged liquid drop so as to be returned to the nozzle. After a predetermined hold time, the drive signal Pk includes a pressing waveform element bk2 whose voltage rises to return the liquid chamber 106 to the original state. Since the slope of this pressing waveform element bk2 is made gentle, no further liquid drop is discharged from the nozzle.

Next, another embodiment of the invention will be described with reference to FIG. 9B.

In this embodiment, the drive waveform generating part 401 is arranged so that a discharge drop speed of the amount of liquid drop smaller than the minimum discharge drop amount used for image formation is slower than that of the liquid drop of the minimum discharge drop amount used for image formation.

As shown in the example of the drive waveform of FIG. 9B, the drive waveform generating part 401 is arranged so that the falling time Tfb of the second discharge drive signal Pk is modified to be equal to the falling time Tfa of the first discharge drive signal P1. Specifically, the slope of the drawing waveform element ak is made gentle as indicated by the dotted line in FIG. 9B. Thereby, the discharge drop speed by the drive signal Pk is made slower while the discharge drop amount of the liquid drop discharged by the drive signal Pk is smaller than the minimum discharge drop amount used for image formation discharged by the drive signal P1.

If the discharge drop speed of the amount of liquid drop smaller than the minimum discharge drop amount used for image formation is smaller than that of the liquid drop of the minimum discharge used for image formation, the liquid drop by idle discharge may not reach the recording sheet. However, the purpose of idle discharge is to perform maintenance and recovery of the nozzle by discharging a liquid drop therefrom. It is not necessary that the liquid drop by idle discharge reaches the recording sheet.

According to this embodiment, the recording head is caused to discharge the amount of liquid drop smaller than the minimum discharge drop amount used for image formation, at a slow drop speed, when performing idle discharge operation, and it is possible to avoid staining the recording sheet.

Figure 20:
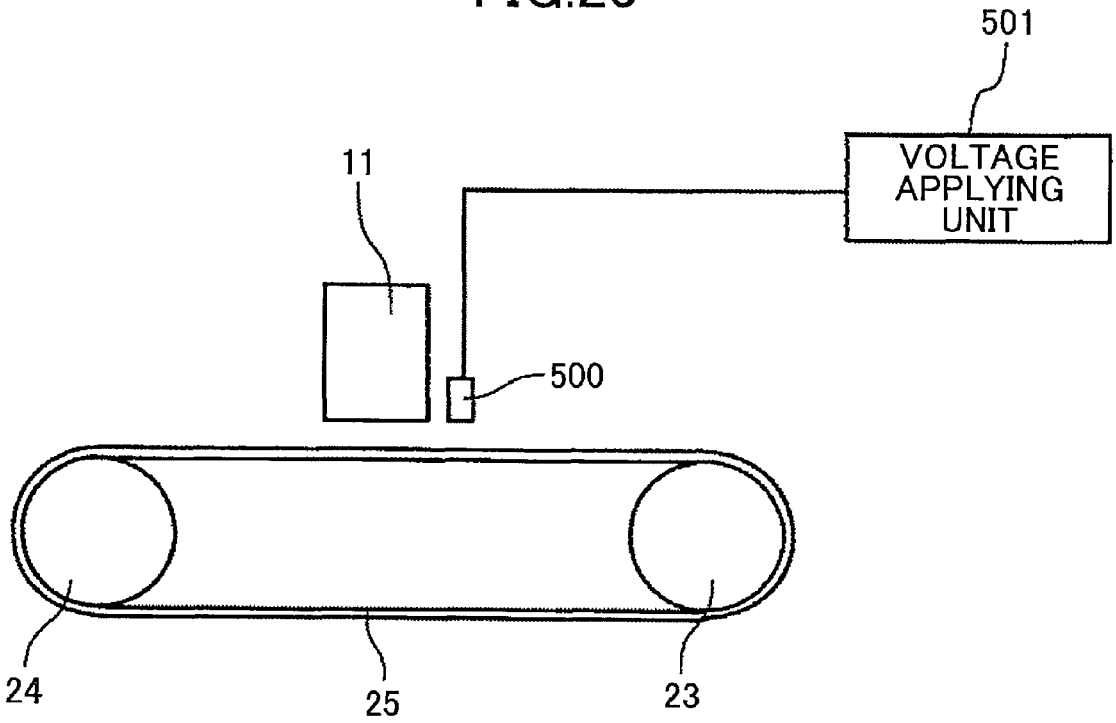
FIG. 20 is a diagram showing the composition of an image forming device in an embodiment of the invention.

Next, another embodiment of the invention will be described with reference to FIG. 20. FIG. 20 shows the composition of an image forming device in an embodiment of the invention.

In this embodiment, an electrode 500 is disposed in a vicinity of the side of the recording head 1, and a voltage applying unit 501 is arranged to apply a charging voltage for charging the electrode 500 to the electrode 500. When idle discharge operation is performed in this embodiment, the electrode 500 is charged by the voltage applying unit 501. The electrode 500 has a length equivalent to the length of the nozzle row of the recording head 1 in the longitudinal direction.

When the amount of liquid drop smaller than the minimum discharge drop amount used for image formation is discharged without reaching the medium, or when idle discharge is performed, the liquid drops generated by the idle discharge operation float as in the previously described embodiment. If a transporting unit which is charged to perform electrostatic attraction of a recording sheet is used as the transporting belt 25, the liquid drops outputted by the recording head 1 are electrostatically charged by the charge of the transporting belt 25. In this case, the voltage applying unit 501 applies the charging voltage to the electrode 500 for charging the electrode 500 in the polarity opposite to the polarity of the charge of the liquid drops, so that the liquid drops are attracted by the charged electrode 500, and it is possible for the present embodiment to prevent scattering of the liquid drops.

Figure 21:
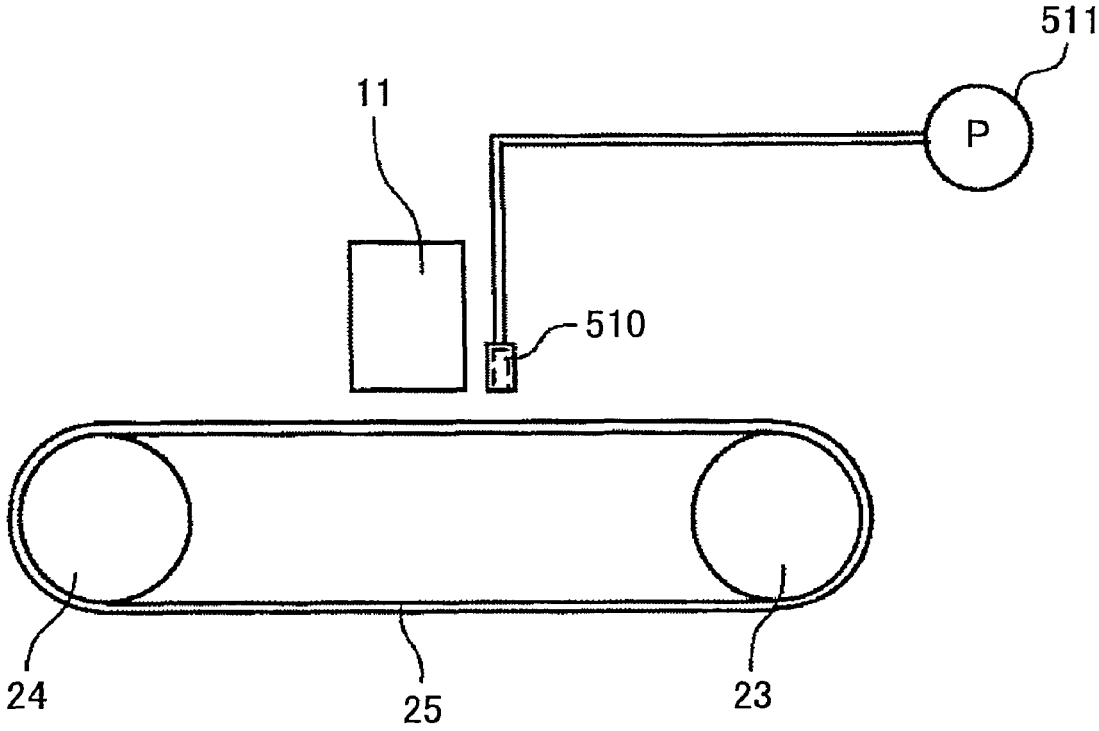
FIG. 21 is a diagram showing the composition of an image forming device in an embodiment of the invention.

Next, another embodiment of the invention will be described with reference to FIG. 21. FIG. 21 shows the composition of an image forming device in an embodiment of the invention.

In this embodiment, a suction passage 510 which has an opening to the recording head 1 is arranged in a vicinity of the side of the recording head 1, and a suction pump (suction unit) 511 is arranged to attract liquid drops through the suction passage 510. When idle discharge operation is performed, the suction pump 511 is operated to attract the liquid drops generated by the idle discharge operation. When idle discharge is performed, the liquid drops generated by the idle discharge operation float as in the previously described embodiment. It is possible for the present embodiment to prevent the scattering of the liquid drops by driving the suction pump 511 to attract the liquid drops through the suction passage 510. The opening of the suction passage 510 has a length equivalent to the length of the nozzle row of the recording head 1 in the longitudinal direction.

In the above-mentioned embodiments, the case in which the present invention is applied to the image forming device having the printer configuration has been described. Alternatively, the present invention may be applied to any of image forming devices, including a fax, a copier, and a multi-function peripheral. The present invention may be applied also to an image forming device which uses a liquid other than the printing ink.

The present invention is not limited to the above-described embodiments, and variations and modifications may be made without departing from the scope of the present invention.

The present application is based on and claims the benefit of priority of Japanese patent application No. 2006-316381, filed on Nov. 23, 2006, and Japanese patent application No. 2007-216336, filed on Aug. 22, 2007, the entire contents of which are hereby incorporated by reference.

The invention claimed is:

1. An image forming device which forms an image on a medium and includes a liquid discharge head in which a plurality of nozzles for discharging liquid drops are arranged side by side, comprising:

a drive waveform generating unit generating, within a single drive cycle, a first drive waveform containing a drive signal to discharge an amount of liquid drop used for image formation, and a second drive waveform containing a drive signal to discharge an amount of liquid drop smaller than a minimum discharge drop amount used for image formation; and a head control unit causing the liquid discharge head to discharge the amount of liquid drop used for image formation in accordance with the first drive waveform for a region where an image is formed, and causing the liquid discharge head to discharge the amount of liquid drop smaller than the minimum discharge drop amount in accordance with the second drive waveform for a region where any image is not formed, wherein each of the drive signal in the first drive waveform and the drive signal in the second drive waveform contains a drawing waveform element which causes a liquid chamber communicating with one of the plurality of nozzles of the liquid discharge head to expand, and a voltage change of the drawing waveform element of the drive signal in the second drive waveform is larger than a voltage change of the drawing waveform element of the drive signal in the first drive waveform.

2. The image forming device according to claim 1, wherein the region where any image is not formed corresponds to a region of the medium in which the medium is transported in a transport direction.

3. The image forming device according to claim 1, wherein the region where any image is not formed corresponds to an end portion of the image-formation region of the medium in a direction perpendicular to a transporting direction in which the medium is transported.

4. The image forming device according to claim 1, wherein each of the drive signal in the first drive waveform and the drive signal in the second drive waveform contains a pressing waveform element which makes a liquid drop discharge by shrinking a liquid chamber communicating with one of the plurality of nozzles of the liquid discharge head, and a voltage change of the pressing waveform element of the drive signal in the second drive waveform is smaller than a voltage change of the pressing waveform element of the drive signal in the first drive waveform.

5. The image forming device according to claim 1, wherein the liquid discharge head is a full-line type recording head.

6. The image forming device according to claim 1, wherein the medium is a rolled-form medium.

7. The image forming device according to claim 1, wherein the image forming device is arranged so that when an idle discharge operation is performed to discharge liquid drops which do not contribute to image formation, the liquid discharge head discharges, over an entire image formable region of the medium in a width direction of the medium, the amount of liquid drop smaller than the minimum discharge drop amount.

8. A printed matter on which an image is formed by the image forming device of claim 1 through discharging of liquid drops to the medium.

9. An image forming device which forms an image on a medium and includes a liquid discharge head in which a plurality of nozzles for discharging liquid drop are arranged side by side, comprising:

a drive waveform generating unit generating, within a single drive cycle, a first drive waveform containing a first drive signal to discharge an amount of liquid drop used for image formation, and a second drive waveform containing a second drive signal to discharge an amount of liquid drop smaller than a minimum discharge drop amount used for image formation; and a selecting unit selecting at least one of the first drive signal in the first drive waveform and the second drive signal in the second drive waveform in response to a control signal, to output the selected drive signal to the liquid discharge head, wherein each of the drive signal in the first drive waveform and the drive signal in the second drive waveform contains a drawing waveform element which causes a liquid chamber communicating with one of the plurality of nozzles of the liquid discharge head to expand, and a voltage change of the drawing waveform element of the drive signal in the second drive waveform is larger than a voltage change of the drawing waveform element of the drive signal in the first drive waveform.

10. The image forming device according to claim 9, wherein the drive waveform generating unit is arranged to generate a plurality of the first drive signals in time series, and the second drive signal being interposed between two of the plurality of the first drive signals.

11. The image forming device according to claim 9, wherein the selecting unit is arranged to select the second drive signal concurrently with the first drive signal when forming an image.

* * * * *